US005556741A

United States Patent [19]

Suga et al.

[11] Patent Number: 5,556,741

[45] Date of Patent: Sep. 17, 1996

[54] SILVER HALIDE EMULSION, METHOD OF MANUFACTURING THE SAME, AND PHOTOSENSITIVE MATERIAL USING THIS EMULSION

[75] Inventors: Yoichi Suga; Yoshio Ishii; Masakazu Morigaki, all of Minami-ashigara, Japan

[73] Assignee: Fuji Photo Film Co., Ltd., Kanagawa, Japan

[21] Appl. No.: 476,335

[22] Filed: Jun. 7, 1995

[30] Foreign Application Priority Data

Jun. 13, 1994 [JP] Japan ..... 6-153085

[51] Int. Cl.[6] ..... G03C 1/005; G03C 1/08

[52] U.S. Cl. ..... 430/569; 430/567; 430/600; 430/603; 430/607; 430/611

[58] Field of Search ..... 430/600, 572, 430/607, 613, 214, 603, 611, 567, 569

[56] References Cited

U.S. PATENT DOCUMENTS 4,963,475 10/1990 Murai et al. ..... 430/600
5,061,614 10/1991 Takada et al. .

*Primary Examiner*—Thorl Chea
*Attorney, Agent, or Firm*—Birch, Stewart, Kolasch & Birch, LLP

[57] ABSTRACT

There is disclosed a silver halide photosensitive material having at least one silver halide emulsion layer coated on a support, wherein silver halide grains in the emulsion layer are subjected to reduction sensitization and contain a radical scavenger, prior to the completion of a chemical sensitization. There is also disclosed a silver halide emulsion and a method of manufacturing the same. The said silver halide photosensitive material has a enhanced sensitivity, without causing high fog.

25 Claims, No Drawings

SILVER HALIDE EMULSION, METHOD OF MANUFACTURING THE SAME, AND PHOTOSENSITIVE MATERIAL USING THIS EMULSION

FIELD OF THE INVENTION

The present invention relates to a silver halide photosensitive material, and more particularly to a silver halide photosensitive material containing reduction-sensitized silver halide grains, which material has high sensitivity and excellent granularity.

BACKGROUND OF THE INVENTION

In order to obtain high sensitivity, reduction sensitization has been investigated for a long time. Disclosed reduction sensitizers include Tin compounds, in U.S. Pat. No. 2,487,850 by Carrol; polyamine compounds, in U.S. Pat. No. 2,512,925 by Lowe et al.; and thiourea dioxide compounds, in GB Patent No. 789,823 by Fallens et al. Furthermore, physical properties of silver nuclei produced by a variety of reduction sensitization methods were compared by Collier, as described in Photographic Science and Engineering, 23, p. 113 (1979). She employed several methods using dimethylamine borane, stannous chloride, hydrazine, high pH ripening, and low pAg ripening, for this purpose. Further, reduction sensitization methods are disclosed in U.S. Pat. Nos. 2,518,698, 3,201,254, 3,411,917, 3,779,777, and 3,930,867. A means of reduction sensitization, as well as a selection of reduction sensitizers, is described in JP-B ("JP-B" means examined Japanese patent publication) Nos. 33572/1982 and 1410/1983. Moreover, a method of improving the storage stability of reduction-sensitized emulsions is disclosed in JP-A ("JP-A" means unexamined published Japanese patent application) Nos. 82831/1982 and 178445/1985. Further, Takada et al. disclose a method of preparing an emulsion reduction-sensitized with thiosulfonic acid, in JP-A No. 191938/1990. Though many investigations were tried as mentioned above, these reduction sensitization methods were not adequate for providing sufficiently high sensitivity, as compared to hydrogen sensitization, wherein a photosensitive material is subjected to hydrogen gas processing. This is reported by Moisar et al. in the Journal of Imaging Science, vol. 29, p. 233 (1985).

On the other hand, JP-A No. 162546/1984 discloses that a hydroxyl amine compound improves latent image intensification. However, this method did not give high sensitivity to a silver halide emulsion.

SUMMARY OF THE INVENTION

The object of the present invention is to provide a silver halide photosensitive material that has enhanced sensitivity without increasing fog.

Other and further objects, features, and advantages of the invention will appear more fully from the following description.

DETAILED DESCRIPTION OF THE INVENTION

As a result of intensive investigation, the present inventors have found that the above-mentioned object of this invention can be achieved by:

(1) A silver halide emulsion, subjected to both reduction sensitization and gold chalcogen sensitization (an ordinary gold sensitization and chalcogen sensitization may be performed), and containing at least a radical scavenger;

(2) A method of manufacturing a silver halide emulsion, which comprises steps of subjecting the silver halide emulsion to reduction sensitization, and then adding thereto at least a radical scavenger, prior to completion of gold chalcogen sensitization;

(3) A silver halide photosensitive material that comprises a support having thereon at least one layer containing a silver halide emulsion, wherein the silver halide emulsion is manufactured by steps of subjecting the silver halide emulsion to reduction sensitization, and then adding thereto at least a radical scavenger, prior to the completion of gold chalcogen sensitization;

(4) A silver halide photosensitive material having at least one silver halide emulsion layer coated on a support, wherein silver halide grains in the emulsion layer are subjected to reduction sensitization, and wherein the silver halide photosensitive material contains a radical scavenger represented by general formula (A) as set forth below, prior to the completion of a chemical sensitization:

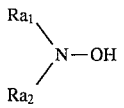

general formula (A)

wherein $R_{a1}$ represents an alkyl group, an alkenyl group, an aryl group, a heterocyclic group, an acyl group, a sulfonyl group, a sulfinyl group, a carbamoyl group, a sulfamoyl group, an alkoxycarbonyl group, or an aryloxycarbonyl group; $R_{a2}$ is a hydrogen atom or a group represented by $R_{a1}$, with the proviso that when $R_{a1}$ is an alkyl group, an alkenyl group, or an aryl group, $R_{a2}$ is a heterocyclic group, an acyl group, a sulfonyl group, a sulfinyl group, a carbamoyl group, a sulfamoyl group, an alkoxycarbonyl group, or an aryloxycarbonyl group; and $R_{a1}$ and $R_{a2}$ may combine together to form a 5- to 7-membered ring;

(5) The silver halide photosensitive material as described in (4), wherein said silver halide grains, subjected to the reduction sensitization and containing the radical scavenger represented by general formula (A), in said emulsion layer are tabular silver halide grains having an aspect ratio of not less than 3, and having dislocation lines, in an amount of at least 60% of the total projected area of these grains; and (6) The silver halide color photosensitive material as described in (3), (4), or (5), containing at least a color coupler.

The reduction sensitization used in the present invention is explained below.

The production steps of the silver halide emulsion are classified into a grain formation step, a desalting step, a chemical sensitization step, etc. The grain formation step is classified into core grain formation, ripening, growth, etc. These steps may be variably preformed; that is, the step order may be changed or some steps may be repeated. The term "to be subjected to reduction sensitization during the production of the silver halide emulsion" means that basically the reduction sensitization can be performed in any step. In other words, reduction sensitization may be carried out at any time, including core grain formation (i.e., the initial stage of the grain formation), physical ripening, growth, the period prior to a chemical sensitization other than the reduction sensitization, or after the completion of the chemical sensitization. The chemical sensitization herein referred to means a chemical sensitization except for the reduction sensitization. When a chemical sensitization is performed in combination with the gold sensitization, it is preferable to perform the reduction sensitization prior to the chemical sensitization, so that undesirable fog may not be formed. It is most preferable to carry out the reduction sensitization during growth of the silver halide grains. The words "during growth" herein referred to mean that the reduction sensitization is being carried out while the silver halide grains are growing by means of physical ripening or the addition of a water-soluble silver salt and a water-soluble alkali halide. In addition, the words also mean that the reduction sensitization is carried out in a condition wherein growth of the silver halide grains is temporarily stopped, and then the growth is resumed.

As the reduction sensitization of the present invention, any one of the following can be used: a method wherein a known reduction sensitizing agent is added to a silver halide emulsion; a method called silver ripening, wherein growing or ripening is carried out in an atmosphere having a pAg as low as 1 to 7; and a method called high-pH ripening, wherein growing or ripening is carried out in an atmosphere having a pH as high as 8 to 11. Two or more of these methods can be used in combination.

The method wherein a reduction sensitizing agent is added is a preferable method because the level of the reduction sensitization can be adjusted subtly.

As the reduction sensitizing agent, stannous salts, amines and polyamines, hydrazine derivatives, formamidine sulfinic acid, silane compounds, and borane compounds are known. For the reduction sensitization of the present invention, these known reduction sensitizing agents can be chosen to be used, and two or more of these compounds can be used in combination. As the reduction sensitizing agent, stannous chloride, thiourea dioxide, and dimethylamineborane are preferable compounds. Although the amount of the reduction sensitizing agent to be added is dependent on the production conditions of the emulsion, suitable amounts are in the range of $10^{-7}$ to $10^{-3}$ mol per mol of the silver halide.

As the reduction sensitizing agent of the present invention, ascorbic acid and its derivatives can also be used.

As specific examples of ascorbic acid and its derivatives (hereinafter referred to as "ascorbic acid compound"), the following can be mentioned:

(AA-1) L-ascorbic acid (AA-2) Sodium L-ascorbate (AA-3) Potassium L-ascorbate (AA-4) DL-ascorbic acid (AA-5) Sodium D-ascorbate (AA-6) L-ascorbic acid-6-acetate (AA-7) L-ascorbic acid-6-palmitate (AA-8) L-ascorbic acid-6-benzoate (AA-9) L-ascorbic acid-5,6-diacetate (AA-10) L-ascorbic acid-5,6-O-isopropylidene (AA-11) D-ascorbic acid Preferably the ascorbic acid compound used in the present invention is used in a larger amount than the conventional amount in which a reduction sensitizer is preferably used. It is described in, for example, JP-B No. 33572/1982, that the amount of the reduction sensitizer is usually not larger than $0.75\times10^{-2}$ milliequivalents per 1 g of silver ion ($8\times10^{-4}$ mol per 1 mol of AgX), and the amount of 0.1 to 10 mg per 1 kg of silver nitrate ($10^{-7}$ to $10^{-5}$ mol of ascorbic acid per 1 mol of AgX) is effective in many occasions (the conversion values were calculated by the present inventor). U.S. Pat. No. 2,487,850 describes that the addition amount of a tin compound as a reduction sensitizer is $1\times10^{-7}$ to $44\times10^{-6}$ mol. Further, JP-A No. 179835/1982 describes that it is suitable to use thiourea dioxide in an amount of about 0.01 mg to about 2 mg per 1 mol of silver halide, and stannous chloride in an amount of about 0.01 mg to about 3 mg per 1 mol of silver halide. A preferable addition amount of the ascorbic acid compound used in the present invention varies depending on such factors as the grain size of the silver halide emulsion, the halogen composition thereof, and each of the temperature, pH, and pAg used for the production of the silver halide emulsion. However, generally a preferable addition amount may be selected from a range of $5\times10^{-5}$ to $1\times10^{-1}$ mol per 1 mol of silver halide, more preferably from $5\times10^{-4}$ mol to $1\times10^{-2}$ mol, and most preferably from $1\times10^{-3}$ mol to $1\times10^{-2}$ mol.

The reduction sensitizing agent is dissolved in a solvent, such as water, alcohols, glycols, ketones, esters, and amides; and it is added during the formation of the grains, before the chemical sensitization, or after the chemical sensitization. The reduction sensitizing agent may be added in any step of producing the emulsion, and particularly preferably it is added during the growth of the grains. Although the reduction sensitizing agent may previously be added into a reaction vessel, preferably the reduction sensitizing agent is added at a suitable time during the growth of the grains. It is also possible that the reduction sensitizing agent may be previously added to an aqueous solution of a water-soluble silver salt or a water-soluble alkali halide solution, and then these aqueous solutions are used to precipitate silver halide grains. Also, preferably a solution of the reduction sensitizing agent is added in portions or continuously during the growth of the grains over a long period of time.

The radical scavenger used in the present invention is a compound that is able to make galvinoxyl substantially colorless (decrease the absorption efficient of galvinoxyl at 430 nm). This is determined by the following steps: (1) mixing an ethanol solution containing 0.05 mmol $dm^{-3}$ of galvinoxyl and an ethanol solution containing 2.5 mmol $dm^{-3}$ of a test compound at 25° C. according to a stopped flow method, and then (2) measuring the change of absorption efficient at 430 nm over a certain period of time. When the test compound does not fully dissolve at the given concentration, a measurement of the absorption efficient may be performed at a lower concentration.

The color diminishing velocity constant of galvinoxyl determined by the above method is preferably not less than 0.01 $mmol^{-1}\ s^{-1}dm^3$, and more preferably not less than 0.1 $mmol^{-1}s^{-1}dm^3$.

A method of determining a radical scavenging velocity using galvinoxyl is described in Microchemical Journal, 31, pp. 18 to 21 (1985), and the stopped flow method is described in, for example, Bunko-kenkyu (Spectroscopic study), 19, No. 6 (1970) p. 321.

It is more preferable to use a compound represented by general formula (A) as a radical scavenger in the present invention. The compound represented by general formula (A) is explained below in detail.

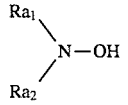

general formula (A)

In general formula (A), $R_{a1}$ represents an alkyl group preferably having 1 to 36 carbon atoms, and more preferably 1 to 26, such as methyl, ethyl, i-propyl, cyclopropyl, butyl, isobutyl, cyclohexyl, t-octyl, decyl, dodecyl, hexadecyl, and benzyl; an alkenyl group preferably having 2 to 36 carbon atoms, and more preferably 2 to 26, such as allyl, 2-butenyl, isopropenyl, oleyl, and vinyl; an aryl group preferably having 6 to 40 carbon atoms, and more preferably 6 to 30, such as phenyl and naphthyl; a heterocyclic group that is a group capable of forming a 5- to 7-membered hetero ring, which ring contains at least one of ring-forming atoms consisting of a nitrogen atom, a sulfur atom, an oxygen atom, and a phosphorus atom (preferably a nitrogen atom-containing heterocyclic group, more preferably a heterocyclic group containing 1 to 4 nitrogen atoms, and most preferably a 5- to 6-membered heterocyclic group containing 1 to 3 nitrogen atoms), such as 1,3,5-triazine-2-yl, 1,2,4-triazine-3-yl, pyridine-2-yl, pyrazinyl, pyrimidinyl, purinyl, quinolyl, imidazolyl, 1,2,4-triazole-3-yl, benzimidazole-2-yl, thienyl, furyl, imidazolidinyl, pyrrolinyl, tetrahydrofuranyl, and morpholinyl; an acyl group, such as acetyl, benzoyl, pyvaloyl, α-(2,4-di-tert-amylphenoxy)butylyl, myristoyl, stearoyl, naphthoyl, m-pentadecylbenzoyl, and isonicotinoyl; a sulfonyl group (preferably alkane or aryl sulfonyl groups), such as methanesulfonyl, octane sulfonyl, benzenesulfonyl, and toluensulfonyl; a sulfinyl group (preferably alkane or aryl sulfinyl groups), such as methanesulfonyl and benzenesulfinyl; a carbamoyl group, such as N-ethylcarbamoyl, N-phenylcarbamoyl, N,N-dimethylcarbamoyl, and N-butyl-N-phenylcarbamoyl; a sulfamoyl group, such as N-methylsulfamoyl, N,N-diethylsulfamoyl, N-phenylsulfamoyl; N-cyclohexyl-N-phenylsulfanoyl, and N-ethyl-N-dodecylsulfamoyl; an alkoxycarbonyl group, such as methoxycarbonyl, cyclohexyloxycarbonyl, benzyloxycarbonyl, isoamyloxycarbonyl, and hexadecyloxycarbonyl; or an aryloxycarbonyl group, such as phenoxycarbonyl and naphthoxycarbonyl. $R_{a2}$ represents a hydrogen atom or groups represented by $R_{a1}$. $R_{a1}$ and $R_{a2}$ may be combined together to form a 5- to 7-membered ring, such as a succinimide ring, a phthalimide ring, a triazole ring, a urazol ring, a hydantoin ring, and a 2-oxo-4-oxazolidinone ring.

Groups each represented by $R_{a1}$ and $R_{a2}$ in general formula (A) may be further substituted with substituents. Examples of these substituents include an alkyl group, an alkenyl group, an aryl group, a heterocyclic group, a hydroxyl group, an alkoxy group, an aryloxy group, an alkylthio group, an arylthio group, an amino group, an acylamino group, a sulfonamide group, an alkylamino group, an arylamino group, a carbamoyl group, a sulfamoyl group, a sulfo group, a carboxyl group, a halogen atom, a cyano group, a nitro group, a sulfonyl group, an acyl group, an alkoxycarbonyl group, an aryloxycarbonyl group, an acyloxy group, and a hydroxyamino group.

Of compounds represented by general formula (A), preferred ones are those wherein $R_{a1}$ is a heterocyclic group, and more preferably a heterocyclic aromatic group that includes a heterocyclic ring that is able to form a heterocyclic aromatic ring in form, as one of the ring's equilibrium structures. The term "heterocyclic aromatic group" is hereinafter used in this meaning. More preferable compounds are represented by the following general formula (A-I):

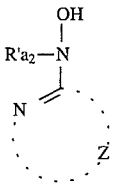

general formula (A-I)

wherein $R'_{a2}$ represents a hydrogen atom, an alkyl group, an alkenyl group, or an aryl group, and Z represents a heterocyclic aromatic group.

Of compounds represented by general formula (A-1), preferred ones are those wherein $R'_{a2}$ represents a hydrogen atom or an alkyl group, or alternatively Z represents a heterocyclic aromatic group containing a carbon atom and a nitrogen atom as a ring-forming atom, and more preferably Z is non-metallic atoms necessary to complete a 5- to 7-membered heteroring containing 1 to 4 nitrogen atoms.

The most preferable compounds are represented by the following general formula (A-II):

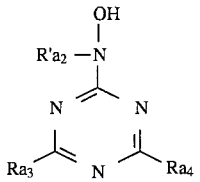

general formula (A-II)

wherein $R'_{a2}$ has the same meanings as $R'_{a2}$ in general formula (A-I), and $R_{a3}$ and $R_{a4}$, which are same or different, each represent a hydrogen atom or a substituent.

Of compounds represented by general formula (A-II), preferred ones are particularly those wherein $R_{a3}$ and $R_{a4}$ each represent a hydroxyamino group, a hydroxyl group, an amino group, an alkylamino group, an arylamino group, an alkoxy group, an aryloxy group, an alkylthio group, an arylthio group, an alkyl group, or an aryl group.

Specific examples of compounds represented by general formula (A) according to the present invention are illustrated below, but they are not intended to restrict the scope of the present invention.

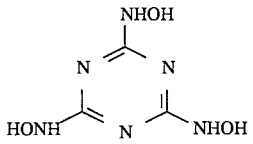

A-1

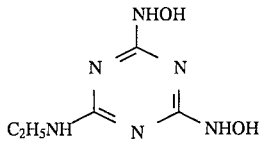

A-2

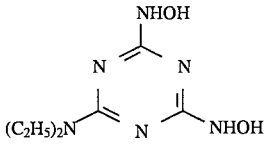

A-3

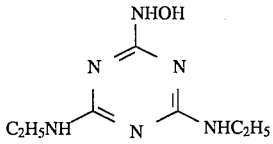

A-4

-continued
A-5
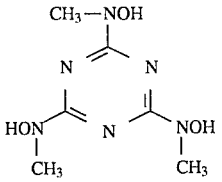
A-6
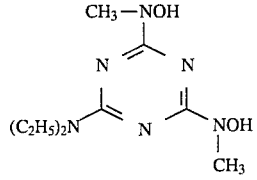
A-7
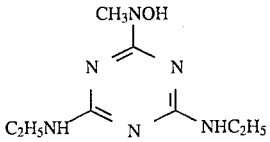
A-8
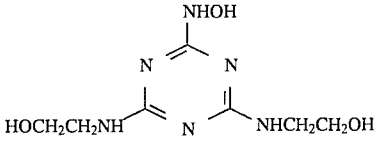
A-9
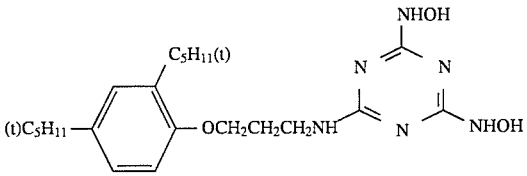
A-10
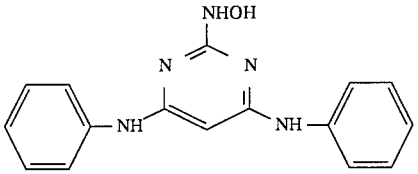
A-11
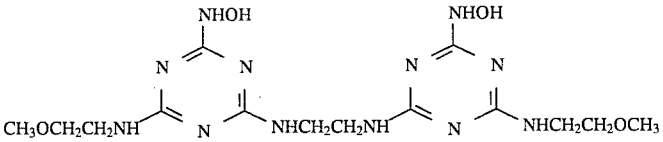
A-12
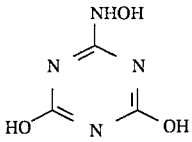
A-13
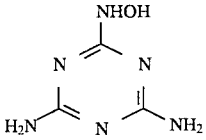
A-14
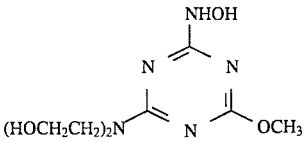
A-15
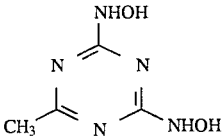
A-16
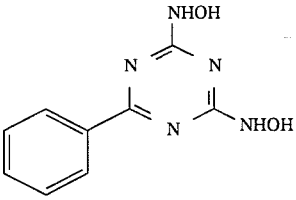
A-17
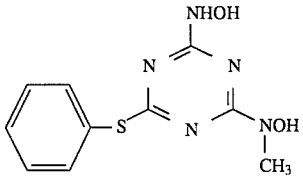
A-18
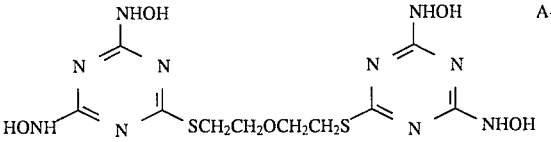
A-19
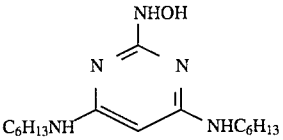
A-20
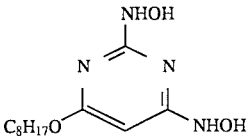
A-21
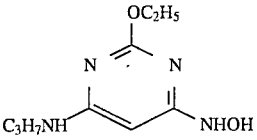
A-22
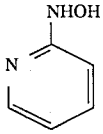
A-23
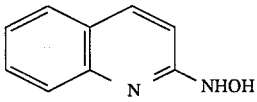

-continued
A-24
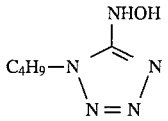
A-25
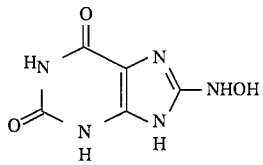
A-26
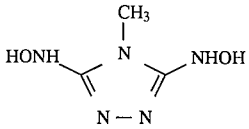
A-27
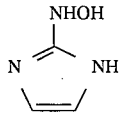
A-28
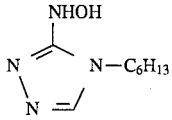
A-29
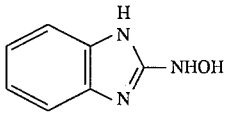
A-30
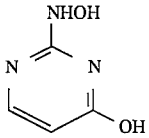
A-31
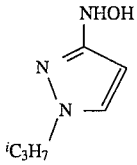
A-32
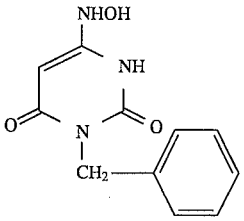
A-33
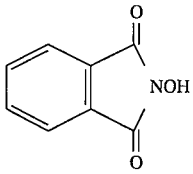
A-34
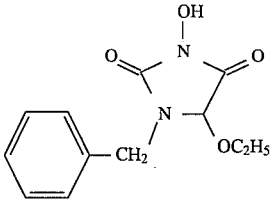
A-35
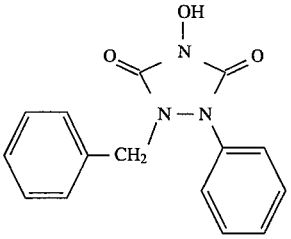
A-36
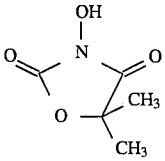
A-37
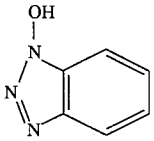
A-38
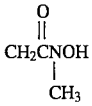
A-39
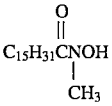
A-40
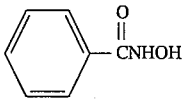
A-41
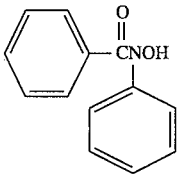
A-42
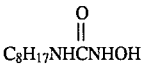
A-43
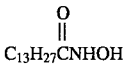

-continued

A-44

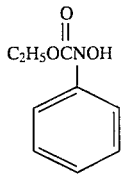

A-45

$(C_2H_5)_2NSO_2NHOH$

A-46

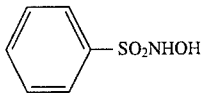

A-47

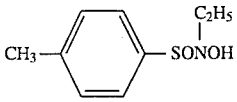

A-48

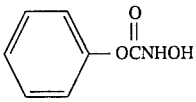

These compounds according to the present invention can be easily synthesized by the methods described in, for example, J. Org. Chem., 27, 4054 ('62); J. Amer. Chem. Soc., 73, 2981 ('51); and JP-B No. 10692/1974, or in a similar manner.

The color-diminishing velocity constants of galvinoxyl, which were determined using several radical scavengers, are shown in Table 1.

TABLE 1

| Compound | Color-deminishing volocity constant ($mmol^{-1}S^{-1}dm^3$) |
|---|---|
| A-3 | 0.8 |
| A-4 | 0.3 |
| A-9 | 0.9 |

In the present invention, a radical scavenger may be added as a solution, in which case the scavenger is dissolved in a water-soluble liquid, such as water, methanol, and ethanol; or alternatively the scavenger may be added as an emulsified dispersion. When the scavenger is dissolved in water, it may be dissolved at a high or low pH depending on its better solubility, to make an aqueous solution, and then the thus obtained solution is added.

In the present invention, two or more kinds of radical scavengers may be used in combination.

In the present invention, the radical scavenger may be added at any time from the beginning of the grain formation but prior to the completion of a chemical sensitization, but it is preferable to add the scavenger after the completion of a reduction sensitization, and more preferably before the beginning of the chemical sensitization. Further, the pH value at which the radical scavenger is added is preferably 7 or less, and more preferably 6 or less.

In the present invention, the term "before the beginning of the chemical sensitization" herein referred to means the time before a chalcogen sensitizer or a gold sensitizer is added, and the term "the completion of a chemical sensitization" means a point of time when the temperature is reduced to finish the chemical sensitization.

In the present invention, the addition amount of the radical scavenger is preferably from $1\times10^{-5}$ to $1\times10^{-2}$ mol per 1 mol of Ag, and more preferably from $1\times10^{-4}$ to $5\times10^{-3}$ mol per 1 mol of Ag.

Multiple silver halide emulsions are usually employed in a multilayer silver halide photosensitive material, and when some of the emulsions are those of the present invention, the addition amount of a radical scavenger based on the silver halide emulsion of the present invention is substantially reduced, because the radical scavenger diffuses in the photosensitive material. For this reason, the radical scavenger may be further added at the coating.

A silver halide photosensitive material of the present invention preferably further contains at least one compound selected from the compounds represented by general formula (B), (C), or (D):

general formula (B) $R^3—SO_2S—M$ general formula (C) $R^3—SO_2S—R^4$ general formula (D) $R^3—SO_2S—Lm—SSO_2—R^5$ wherein $R^3$, $R^4$, and $R^5$ which are same or different, each represent an aliphatic group, an aromatic group, or a heterocyclic group; L represents a divalent group; M represents a cation; and m represents an integer of 0 or 1.

The compounds of general formulae (B), (C), and (D) are further explained below in detail.

Where $R^3$, $R^4$, and $R^5$ are each an aliphatic group, preferred examples thereof are an alkyl group having 1 to 22 carbon atoms, an alkenyl group having 2 to 22 carbon atoms and an alkynyl group, each of which may have a substituent. Specific examples of the alkyl group include methyl, ethyl, propyl, butyl, pentyl, hexyl, octyl, 2-ethylhexyl, decyl, dodecyl, hexadecyl, octadecyl, cyclohexyl, isopropyl, and t-butyl.

Specific examples of the alkenyl group are allyl and butenyl.

Specific examples of the alkynyl group are propargyl and butynyl.

The aromatic group of $R^3$, $R^4$, and $R^5$ preferably has 6 to 20 carbon atoms, and it includes a phenyl group and a naphthyl group, each of which may be substituted.

Examples of the heterocyclic group of $R^3$, $R^4$, and $R^5$ are those composed of a 3- to 15-membered ring containing at least one element selected from nitrogen, oxygen, sulfur, selenium, and tellurium, such as a pyrrolidine ring, a peperidine ring, a pyridine ring, a tetrahydrofuran ring, a thiophene ring, an oxazole ring, a thiazole ring, an imidazole ring, a benzothiazole ring, a benzoxazole ring, a benzimidazole ring, a selenazole ring, a benzselenazole ring, a tetrazole ring, a triazole ring, a benzotriazole ring, a tetrazole ring, an oxadiazole ring, and a thiadiazole ring.

Examples of the substituent for $R^3$, $R^4$, and $R^5$ are an alkyl group (e.g., methyl, ethyl, and hexyl), an alkoxy group (e.g., methoxy, ethoxy, and octyloxy), an aryl group (e.g., phenyl, naphthyl, and tolyl), a hydroxyl group, a halogen atom (e.g., fluorine, chlorine, bromine, and iodine), an aryloxy group (e.g., phenoxy), an alkylthio group (e.g., methylthio and butylthio), an arylthio group (e.g., phenylthio), an acyl group (e.g., acetyl, propionyl, butyryl and valeryl), a sulfonyl group (e.g., methylsulfonyl and phenylsulfonyl), an acylamino group (e.g., acetylamino and benzamino), a sulfonyl amino group (e.g., methanesulfonylamino and benzenesulfonylamino), an acyloxy group (e.g., acetoxy and benzoxy), a carboxyl group, a cyano group, a sulfo group, an amino group, etc.

L is preferably a divalent aliphatic group or a divalent aromatic group. Specific examples of the divalent aliphatic group of L include $-(CH_2)_n-$(n=1 to 12), $-CH_2-CH=CH-CH_2-$, $-CH_2-C\equiv C-CH_2-$,

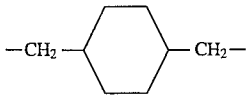

and a xylylene group. Specific examples of the divalent aromatic group of L include phenylene and naphthylene.

These divalent aliphatic or aromatic groups may be further substituted with such a substituent as mentioned hereinbefore.

M is preferably a metal ion or an organic cation. Examples of the metal ion include a lithium ion, a sodium ion, and a potassium ion. Examples of the organic cation include an ammonium ion (e.g., ammonium, tetramethylammonium, and tetrabutylammonium), and phosphonium ion (e.g., tetraphenyl phosphonium), and a quanidine group.

Specific examples of the compounds represented by general formula (B), (C), or (D) are illustrated below, but they are not intended to restrict the scope of the present invention.

$CH_3SO_2SNa$ (B-1)
$C_2H_5SO_2SNa$ (B-2)
$C_3H_7SO_2SK$ (B-3)
$C_4H_9SO_2SLi$ (B-4)
$C_6H_{13}SO_2SNa$ (B-5)
$C_8H_{17}SO_2SNa$ (B-6)

$CH_3(CH_2)_3CH(C_2H_5)CH_2SO_2S\cdot NH_4$ (B-7)

$C_{10}H_{21}SO_2SNa$ (B-8)
$C_{12}H_{25}SO_2SNa$ (B-9)
$C_{16}H_{33}SO_2SNa$ (B-10)

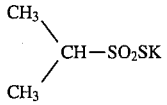
(B-11)

t-$C_4H_9SO_2SNa$ (B-12)
$CH_3OCH_2CH_2SO_2S\cdot Na$ (B-13)

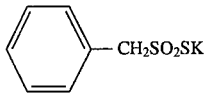
(B-14)

$CH_2=CHCH_2SO_2SNa$ (B-15)

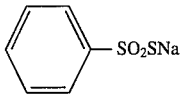
(B-16)

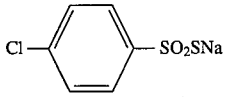
(B-17)

-continued

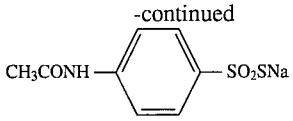
(B-18)

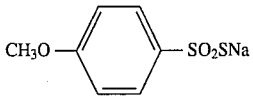
(B-19)

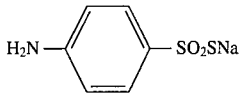
(B-20)

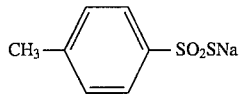
(B-21)

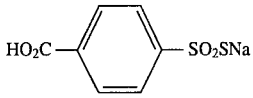
(B-22)

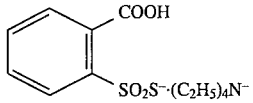
(B-23)

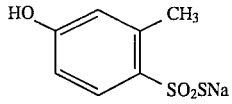
(B-24)

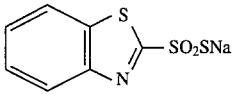
(B-25)

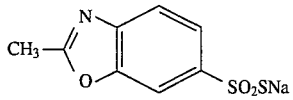
(B-26)

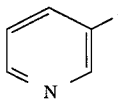
(B-27)

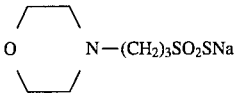
(B-28)

$KSSO_2(CH_2)_2SO_2SK$ (B-29)
$NaSSO_2(CH_2)_4SO_2SNa$ (B-30)
$NaSSO_2(CH_2)_4S(CH_2)_4SO_2SNa$ (B-31)

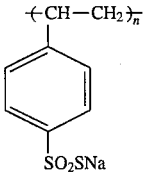
(B-32)

-continued
(B-33)
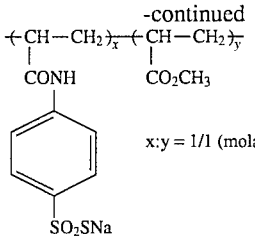
x:y = 1/1 (molar ratio)
$C_2H_5SO_2S-CH_3$ (C-1)
$C_8H_{17}SO_2SCH_2CH_3$ (C-2)
(C-3)
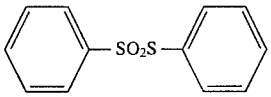
(C-4)
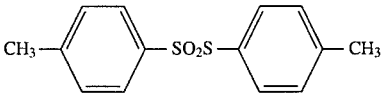
$C_2H_5SO_2SCH_2CH_2CN$ (C-5)
(C-6)
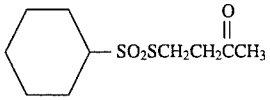
(C-7)
$C_4H_9SO_2SCH(CH_3)CH_2CN$
(C-8)
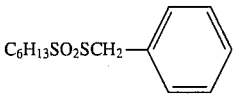
(C-9)
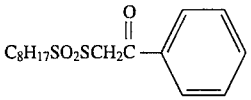
(C-10)
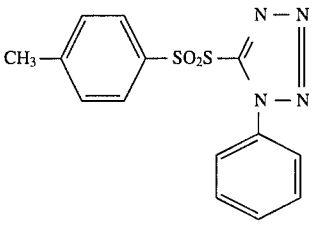
(C-11)
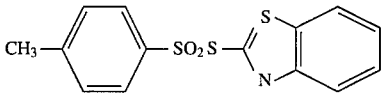
(C-12)
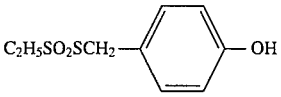
(C-13)
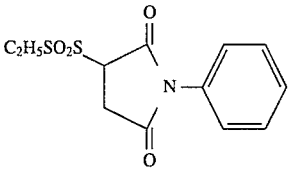
(C-14)
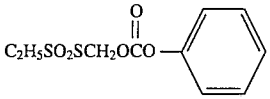
-continued
(C-15)
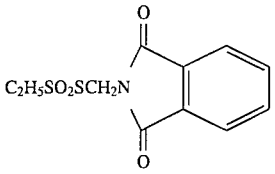
(C-16)
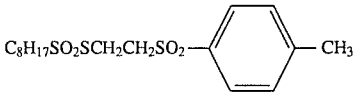
(C-17)
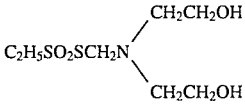
$C_2H_5SO_2SCH_2CH_2CH_2CH_2OH$ (C-18)
(C-19)
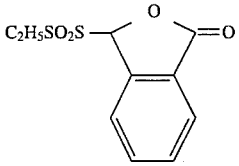
(C-20)
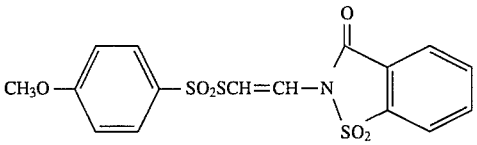
$CH_3SSO_2(CH_2)_4SO_2SCH_3$ (C-21)
$CH_3SSO_2(CH_2)_2SO_2SCH_3$ (C-22)
(C-23)
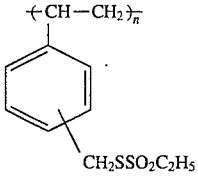
(C-24)
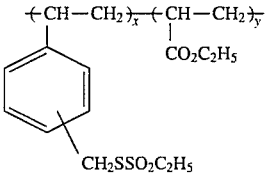
x:y = 2/1 (molar ratio)
(C-25)
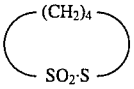
(D-1)
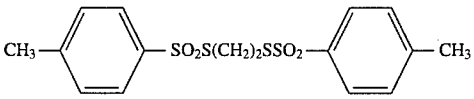
$C_2H_5SO_2SCH_2CH_2SO_2CH_2CH_2SSO_2C_2H_5$ (D-2)
(D-3)
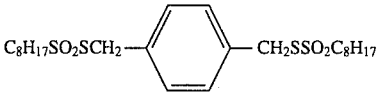

-continued

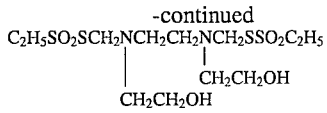

(D-4)

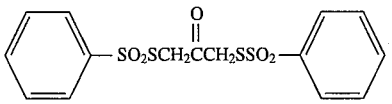

(D-5)

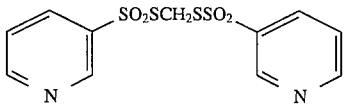

(D-6)

$C_2H_5SO_2SSSO_2C_2H_5$ (D-7)

$(n)C_3H_7SO_2SSSO_2C_3H_7(n)$ (D-8)

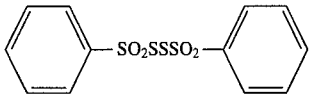

(D-9)

The compounds of general formula (B) can be easily synthesized by the methods as described in JP-A No. 1019/1979 and GB Patent No. 972,211.

It is preferable to add the compound of general formula (B), (C), or (D) in an amount of $10^{-7}$ to $10^{-1}$ mol, more preferably $10^{-6}$ to $10^{-2}$ mol, most preferably $10^{-5}$ to $10^{-3}$ mol, per 1 mol of silver halide, respectively.

In order to add the compound of general formula (B), (C), or (D) during production steps of the photographic emulsion, use can be made of a conventional method that is ordinarily used to incorporate additives into a photographic emulsion. For example, a water-soluble compound can be added as an aqueous solution having a suitable concentration. On the other hand, a water-insoluble or sparingly water-soluble compound can be dissolved in a suitable organic solvent, which has miscibility with water, e.g., a solvent that is selected from alcohols, glycols, ketones, esters, and amides, and which yet does not give any harm to photographic properties; and then this combination may be added as a solution.

The compound of general formula (B), (C), or (D) may be added to a silver halide emulsion at any stage of the production thereof, i.e., during grain formation or before or after a chemical sensitization. It is preferable to add the compound at any time before or during reduction sensitization. It is particularly preferable to add the compound during grain formation.

The compound may be previously added to a reaction vessel. However, it is preferred to add the compound at a suitable stage of the grain formation, rather than the above-mentioned method. Further, silver halide grains may be formed using an aqueous solution of a water-soluble silver salt and an aqueous solution of a water-soluble alkali halide, at least one of which solutions previously contains the compound of general formula (B), (C), or (D). Further, it is preferable to add a solution containing the compound of general formula (B), (C), or (D) in a divided manner or continuously for a long period of time, during grain formation.

Of the compounds represented by general formulae (B), (C), and (D), most preferred compounds for the present invention are one of general formula (B).

An emulsion of the present invention preferably contains tabular silver halide grains having an aspect ratio of not less than 3, and more preferably 3 or more, but less than 8. The term "tabular grains" herein referred to is a general term of the grains having one twin face, or two or more parallel twin faces. The twin face means the (111) face when ions on all of the lattice points at both sides of a (111) face have mirror-image relations. These tabular grains, when viewed in a direction perpendicular to the major faces, are triangular, hexangular, or circular (rounded triangular or hexangular in shape). The triangular grains, the hexangular grains, and the circular grains each have parallel outer surfaces having a triangular, hexangular, and circular shape, respectively.

The aspect ratio of the tabular grains according to the present invention means the value of the grain diameter divided by the thickness of the grain with respect to each tabular grains having a 0.1 μm or larger diameter. The thickness of a grain can be easily determined by the following steps: (i) vaporizing a metal from an oblique direction of the grain with a latex for reference, (ii) measuring the length of the shadow on an electron micrograph, and then (iii) evaluating the length of the shadow of the metal with reference to the length of the shadow of the latex.

The grain diameter herein referred to means the diameter of a circle having an area equal to the projected area of the parallel outer surfaces of the grain.

The projected area of the grain is obtained by measuring an area on an electron micrograph, and then correcting a photographing magnification.

The diameter of the tabular grains is preferably 0.15 to 5.0 μm. Preferably the thickness of such tabular grains is 0.05 to 1.0 μm.

The average aspect ratio is determined as an arithmetic mean of each aspect ratio for at least 100 grains of silver halide grains. Further, the average aspect ratio can be determined as a ratio of the average diameter to the average thickness of the grains.

The emulsion of the present invention contains tabular silver halide grains having an aspect ratio of 3 or over, and preferably an average aspect ratio of 3 or over but less than 8. Preferably such tabular silver halide grains occupy 60% or more of all the projected areas of the emulsion.

Preferably the ratio of the tabular grains is such that those amount to 60% or more, and particularly preferably 80% or more, of all the projected areas.

In some cases, monodisperse tabular grains are used to obtain more preferable results. The structure of monodisperse tabular grains and the method for producing them follow the description, for example, of JP-A No. 151618/1988. The shape thereof can be described briefly as follows: 70% or more of all the projected areas of silver halide grains have hexagonal shapes wherein the ratio of the length of the longest side to the length of the shortest side is 2 or less, and are taken up by tabular silver halide having two parallel outer surfaces. Further, with respect to the hexagonal tabular silver halide grains, the deviation coefficient (the value obtained by dividing the scatter (standard deviation) of the grain sizes in terms of the diameter of the projected area with the shape of the grain assumed to be as a circle by the average grain size) of the grain size distribution of the hexagonal tabular silver halide grains is 20% or less, which shows monodispersion properties.

Further, the grains in the emulsion of the present invention preferably have dislocation lines. Dislocations of the tabular grains can be observed by a direct observation method using a low-temperature transmission electron microscope, as described, for example, in J. F. Hamilton, *Phot. Sci. Eng.*, 11, 57 (1967); and T. Shiozawa, *J. Soc. Phot. Sci. Japan*, 35, 213 (1972). That is silver halide grains, which have been taken out from the emulsion with care so that pressure that would cause dislocations in the grains would not be applied, are placed on a mesh for electron microscope observation and are observed by the transmission method with the sample cooled to prevent damage (e.g., printout) due to an electron ray. In this case, the thicker the grains are, the less the electron ray is transmitted, and therefore if a high-voltage (200 kV or higher for grains having a thickness of 0.25 μm) electron microscope is used, a more clear observation can be made. From the photograph of the grains taken by using the method as described above, the positions and the number of dislocations of each grain viewed perpendicularly to the principal plane can be determined.

The number of dislocation lines is 10 or more, and more preferably 20 or more, per grain on average. When the dislocation lines exist in a crowded condition, or are viewed as being crossed with each other, it is sometimes difficult to exactly count the number of dislocation lines per grain. However, it is possible to count them with such accuracy as identifying about 10, 20, or 30 lines, even in these cases, which can be clearly distinguished from there being only several dislocation lines present. The average number of dislocation lines per grain is determined by counting the number of dislocation lines with respect to 100 grains or more, and then averaging them in number.

The dislocation lines can be introduced into, for example, an outer surface or its vicinity of a tabular grain. In this case, the dislocations are almost perpendicular to the outer surface, and dislocation lines are generated in a direction from a position away from the center of the tabular grain by a distance that is ×% of a length between the center and an edge, to the edge. A value of × is preferably 10 or more, but less than 100, more preferably 30 or more, but less than 99, and most preferably 50 or more, but less than 98. In this case, a shape that is obtained by connecting positions at which dislocations start is close to a similar figure of the tabular grain, but is not always a completely similar figure, i.e., sometimes the shape is distorted. A dislocation of this type is not viewed in a center region of the grain. The direction of dislocation lines is crystallographically about the direction of (211), but sometimes the dislocation lines extend in a zigzag manner, or cross each other.

Further, the tabular grain may have the dislocation lines almost uniformly at all through the outer surface or at a localized region on the outer surface. Taking hexangular tabular silver halide grains as an example, the dislocation lines may be limited to only a vicinity of 6 apices, or to only a vicinity of 1 apex among the 6 apices. On the contrary, the dislocation lines can be limited to only the sides (edges) excluding a vicinity of the 6 apices.

Further, the dislocation lines may be formed over the region including a center of two parallel major planes of the tabular grain. When the dislocation lines are formed all over the region of the major planes, a direction of the dislocation lines, when viewed from the direction perpendicular to the major plane, is usually crystallographically almost the direction of (211), but sometimes the direction is of (110) or at random. Furthermore, each length of the dislocation lines is also random. Therefore some dislocation lines are observed as a short line on the major plane and other dislocation lines are observed as a long line extending to the side (outer surface). Some dislocation lines are straight, but many others extend in a zigzag manner. Further, in many cases they are crossed.

The position of dislocations may be limited to on the outer surface, the major plane, or a localized region as mentioned above, or the dislocations may be formed at a combination thereof. That is to say, the dislocations may exist simultaneously on both the outer surface and the major plane.

In order to introduce dislocation lines on the outer surface of the tabular grain, specific high-silver iodide layers (phases) can be formed in an internal portion of the tabular grains. The high-silver iodide layer herein referred to includes discontinuous high-silver iodide regions. Specifically, such tabular grains can be obtained by the steps of preparing substrate grains, and then forming a high-silver iodide layer on the substrate grains, followed by covering them with a layer having an iodide content lower than that of the high-silver iodide layer. The silver iodide content of the tabular substrate grains is lower than that of the high-silver iodide layer, and it is preferably from 0 to 20 mol %, more preferably from 0 to 15 mol %.

The "high-silver iodide layer in an internal portion of the grain" herein referred to means a silver halide solid solution containing silver iodide. Preferred silver halides are silver iodide, silver iodobromide, and silver chloroiodobromide, and more preferably silver iodide and silver iodobromide (silver iodide content: 10 to 40 mol %). In order to form a high-silver iodide layer in an internal selective position of the grain (hereinafter referred to as an internal high-silver iodide layer), i.e., an edge or a corner of the substrate grains, such localization can be controlled by conditions for forming the substrate grains and the internal high-silver iodide layers. Of the conditions for forming the substrate grains, there can be recited pAg (the cologarithm of silver ion density), a silver halide solvent (a presence or absence, a kind, and an amount thereof), and temperature as an important factor. It is possible to selectively form internal high-silver iodide layers at the vicinity of corners of the substrate grains, by adjusting pAg to 8.5 or less, and more preferably to 8 or less, when the substrate grains are growing. On the other hand, internal high-silver iodide layers can be formed selectively on the edges of the substrate grains, by adjusting pAg to more than 8.5, and more preferably 9 or more, when the substrate grains are growing. The threshold value of the pAg varies up and down depending on temperature; and the presence or absence, the kind, and the amount of the silver halide solvent. For example, when a thiocyanate compound is used as a silver halide solvent, the threshold of the pAg inclines upward. The pAg at the terminal stage of the growth is particularly important as a pAg when the substrate grains are growing. On the other hand, even when the pAg at the step of the growth is out of the above given value, the selective location of the internal high-silver iodide layer can be controlled by adjusting the pAg to the above given value after the substrate grains have grown, followed by ripening. In this case, ammonia, amine compounds, and thiocyanate salts are useful as a silver halide solvent. The internal high-silver iodide layer can be formed by a so-called conversion method. In this method, during a grain formation process, halide ions having a lower solubility of salt forming silver ion than that of silver halide that forms a grain (or a portion close to the surface of grain) at this time, are added. In this invention, an amount of the halide ions having a lower silver salt solubility to be added is preferably larger than a value (associated with a halide composition) with respect to a surface area of the grain at this time. For example, during grain formation, KI is preferably added in an amount larger than a certain value with respect to a surface area of an AgBr grain at this time. More specifically, iodide salt is preferably added in an amount of $8.2\times10^{-5}$ mol/m$^2$ or more.

A more preferable method of producing an internal high-silver iodide layer is to simultaneously add a silver salt aqueous solution and an aqueous solution of a halide salt containing an iodide salt.

For instance, a silver nitrate aqueous solution is added simultaneously with a potassium iodide aqueous solution according to a double jet method. In this method, there may be a difference in addition-starting time and/or addition-terminating time between the potassium iodide aqueous solution and the silver nitrate aqueous solution. The molar ratio of the silver nitrate aqueous solution to be added to the potassium iodide aqueous solution is preferably not less than 0.1, more preferably not less than 0.5, and most preferably not less than 1. The total addition molar amount of the silver nitrate aqueous solution may be a region wherein silver is excessive compared to an amount of a halogen ion in the system and an iodine ion to be added. Preferably the pAg value at the time when an aqueous solution of a halide containing an iodine ion is added with a silver salt aqueous solution according to a double jet method, declines with the addition period involved according to the double jet method. The pAg value at the time when an addition starts is preferably from 6.5 to 13, and more preferably from 7.0 to 11. On the other hand, the pAg value when the addition is terminated is most preferably from 6.5 to 10.0.

When the above-mentioned methods are preformed, the solubility of the silver halide to be mixed is preferably as low as possible. Accordingly, the temperature of the mixture at the time when a high-silver iodide layer is formed is preferably from 30° C. to 70° C., and more preferably from 30° C. to 50° C.

Most preferably, the internal high-silver iodide layer can be formed by adding a fine-grain silver iodide (i.e., fine particles of silver iodide; the term "fine grain" is hereinafter used in the same meaning), or a fine-grain silver iodobromide, or a fine-grain silver chloroiodido, or a fine-grain silver chloroiodobromide. The addition of fine-grain silver iodide is particularly preferred. The grain size of these fine grains is usually from 0.01 μm to 0.1 μm. However, it is possible to use fine grains having a grain size of less than 0.01 μm or more than 0.1 μm. These fine-grain silver halides can be prepared with reference to methods described in Japanese patent application Nos. 7851/1988, 195778/1988, 7852/1988, 7853/1988, 194861/1988, and 194862/1988. An internal high-silver iodide layer can be formed by adding these fine-grain silver halides, and then aging. The above-mentioned silver halide solvent may be used in order to dissolve the fine grains by aging. All of the fine grains that are added are not necessarily instantly dissolved and consumed; rather it is adequate if they are completely dissolved and consumed by the time the final grains have been formed.

The silver iodide content of an outer layer with which an internal high-silver iodide layer is covered, should be lower than that of the internal high-silver iodide layer, preferably such silver iodide content is from 0 to 30 mol %, more preferably from 0 to 20 mol %, and most preferably from 0 to 10 mol %. The location of internal high-silver iodide layers, when measured from a center of a hexangle, etc., formed by a projection of the grain, preferably exists in a range of 5 mol % or more, but less than 100 mol %; more preferably 20 mol % or more, but less than 95 mol %; and most preferably 50 mol % or more, but less than 90 mol %, with respect to the silver amount of the entire silver halide grain. The silver amount of silver halide that constitutes the internal high-silver iodide layer is preferably 50 mol % or less, and more preferably 20 mol % or less, of the silver amount of the entire silver halide grain. The above-mentioned amounts with respect to the internal high-silver iodide layer are based on a recipe for the production of silver halide emulsions, rather than on the values observed by a measurement according to several analytical methods of a halide composition of the final grains. This is because the internal high-silver iodide layer in the final grains often vanishes during a recrystallization step or the like. The all mentioning to the above refers to the production method.

Accordingly, the internal silver iodide layer formed to introduce dislocation lines into the final grains is often difficult to observe as a definite layer, even though the dislocation lines in the final grains can be easily observed according to the above-mentioned methods. For example, an entire outer surface region of the tabular grains is sometimes observed as a high-silver iodide layer. The halogen composition of the tabular grains can be identified by a combination of, for example, X-ray diffraction, an EPMA (also called an XMA) method (in which silver halide grains are scanned by an electron beam to detect a silver halide composition), and an ESCA (also called an XPS) method (in which X rays are radiated to perform spectroscopy for photoelectrons emitted from the grain surface).

The temperature and the pAg to be used for the formation of external layers covering internal high-silver iodide layers are not limited in particular, but a preferable temperature is from 30° C. to 80° C., and most preferably from 35° C. to 70° C. A preferable pAg is from 6.5 to 11.5. Use of the above-mentioned silver halide solvent is sometimes preferred. The most preferred silver halide solvent is a thiocyanate salt.

Dislocation lines can be introduced into major planes of the tabular grains by the following steps: substrate grains are prepared; a silver halochloride is deposited on the major planes of the grains; the silver halochloride is subjected to a halogen conversion, to form high-silver bromide or high-silver iodide layers, and then these layers are covered with shells. As such the silver halochloride, can be mentioned silver chloride, silver chlorobromide, or silver chlorodiodobromide, each having a silver chloride content of not less than 10 mol %, and preferably not less than 60 mol %. A deposition of the silver halochloride on the major planes of the substrate grains can be performed by adding a silver nitrate aqueous solution and an aqueous solution of a suitable alkali metal salt (e.g., potassium chloride), separately or simultaneously, or alternatively by adding the thus obtained silver salt emulsion, and then followed by ripening. The deposition of the silver halochloride can be performed in any pAg region, but the most preferred region is from 5.0 to 9.5. According to these methods, tabular grains grow mainly in a width direction thereof. The amount of silver halochloride layers is preferably from 1 mol % to 80 mol %, and more preferably from 2 mol % to 60 mol %, in terms of the silver content to the entire substrate grain. Dislocation lines can be provided on major planes of the tabular grains, by subjecting the silver halochloride layers to a halogen conversion with a halide aqueous solution that is able to form a silver salt having a lower solubility than that of the silver halochloride. For example, the silver halochloride layers are subjected to a halogen conversion with a KI aqueous solution, and then shells are grown on the layers, whereby final grains can be obtained. The halogen conversion of these silver halochloride layers herein referred to does not mean that the entire silver halochloride is converted to a silver salt having a lower solubility than that of the silver halochloride, but preferably not less than 5%, more preferably not less than 10%, and most preferably not less than 20%, of the silver halochloride is converted to a silver salt having a lower solubility. Dislocation lines can be provided at a local portion of major planes by controlling the structure of the halogen composition of substrate grains in which silver halochloride layers are formed. For example, dislocation lines can be provided only in a peripheral region of the major planes, excluding a central region thereof, by using substrate grains having an internal high-silver iodide structure with a displacement in a side direction of the tabular substrate grains. On the other hand, dislocation lines can be provided only in a central region of the major planes, excluding a peripheral region thereof, by using substrate grains having an external high-silver chloride structure with a displacement in a side direction of the tabular substrate grains. Furthermore, a silver halochloride can be deposited only on a limited area by using a site director of epitaxial growth of the silver halochloride, such as an iodide; thereby dislocation lines can be provided at the limited area. The temperature at which a silver halochloride is deposited is preferably from 30° C. to 70° C., and more preferably from 30° C. to 50° C. After deposition of the silver halochloride, halogen conversion can be performed prior to or during the growth of shells.

The location of the internal silver halochloride layer to be formed almost parallel to major planes preferably exists in a direction from the center of the width to both sides of the tabular grain; and in a region of 5 mol % or more, but less than 100 mol %; more preferably 20 mol % or more, but less than 95 mol %; and particularly preferably 50 mol % or more, but less than 90 mol %, in terms of the silver amount of the entire grain.

The silver iodide content of the shells is preferably from 0 to 30 mol %, and more preferably from 0 to 20 mol %. The temperature and the pAg at which shells are formed are not limited in particular, but a preferable temperature is from 30° C. to 80° C. The most preferable temperature is from 35° C. to 70° C. A preferable pAg is from 6.5 to 11.5. Sometimes, the above described silver halide solvents are preferably used, and the most preferable silver halide solvent is a thiocyanate salt. Sometimes, the internal silver halochloride layers subjected to halogen conversion cannot be identified in final grains by the above-mentioned analytical methods, depending on the conditions, such as the degree of halogen conversion. However, dislocation lines are clearly observed.

Dislocation lines may be provided by suitably combining a method of providing dislocation lines at any location on major planes of the tabular grains and a method of providing dislocation lines at any location on the above-mentioned peripheral region of the tabular grains.

Silver halides in silver emulsions that may used in combination with the silver halide emulsion of the present invention include silver bromide, silver iodobromide, silver iodochlorobromide, and silver chlorobromide. Preferable silver halides are silver iodobromide having a silver iodide content of not more than 30 mol %, or silver iodochlorobromide.

Tabular grains used in the present invention can be easily prepared by methods described, for example, by Cleve in *Photoqraphic Theory and Practice* (1930), page 131; by Gutoff in *Photographic Science and Engineering*, Vol. 14, pages 248 to 257 (1970); and in U.S. Pat. Nos. 4,434,226, 4,414,310, 4,433,048, and 4,439,520, and British Patent No. 2,112,157.

Generally, a silver halide emulsion is chemically sensitized. As for chemical sensitization, for example, a method described in *Die Grundlagen der Photographischen Prozesse mit Silberhalogeniden*, edited by H. Frieser, Akademische Verlagsgesellschaft, pages 675 to 734 (1986), can be used.

That is, sulfur sensitization, wherein sulfur-containing compounds capable of reacting with an active gelatin and a silver, such as thiosulfates, thioureas, mercapto compounds, and rhodanines, are used; reduction sensitization, wherein reducing substances, such as stannous salts, amines, hydrazine derivatives, formamidine sulfinic acid, and silane compounds, are used; noble metal sensitization, wherein noble metal compounds, such as gold complex salts, and complex salts of other metals of the VIII group in the periodic table (Pt, Ir, Pd, etc.), are used; and selenium sensitization, wherein selenium compounds, such as selenoureas, selenoketones, and selenides, are used, can be used alone or in combination.

In the photographic emulsion used in the present invention, various compounds can be contained in order to prevent fogging during the process for producing the photographic material, during the storage of the photographic material, or during the photographic processing, or in order to stabilize the photographic performance. That is, many compounds known as antifogging agents or stabilizers can be used, such as azoles, for example benzothiazolium salts, nitroimidazoles, triazoles, benzotriazoles, and benzimidazoles (particularly nitro- or halo-substituted compound); heterocyclic mercapto compounds, for example mercaptothiazoles, mercaptobenzothiazoles, mercaptobenzimidazoles, mercaptothiadiazoles, mercaptotetrazoles (particularly 1-phenyl-5-mercaptotetrazole), and mercaptopyrimidines; the above heterocyclic mercapto compounds having a water-soluble group, such as a carboxyl group and a sulfone group; thioketo compounds, for example oxadolinethion; azaindenes, for example tetraazaindenes (particularly 4-hydroxy-substituted (1,3,3a,7)tetraazaindenes); benzenethiosulfonic acids; and benzenesulfinic acids.

The addition time of these antifoggants or stabilizers is usually after chemical sensitization, but it can be preferably selected from a period of the middle or not later than the start of a chemical ripening. That is to say, in a silver halide emulsion grains formation process, they may be added while a silver salt solution is added, or at any time of from the addition of the silver salt solution to the start of a chemical ripening, or in the middle of a chemical ripening (i.e., during a chemical ripening, preferably within a time period of from the start to 50%, and more preferably 20% of the entire chemical ripening).

It is difficult to unitarily specify an addition amount of the above-described compounds to be used in the present invention by addition method or amount of silver halide, but a preferable amount is from $10^{-7}$ mol to $10^{-2}$ mol, and more preferable amount is from $10^{-5}$ to $10^{-2}$ mol, per 1 mol of silver halide, respectively.

As a preservative (i.e., a binder or a protective colloid) for a photographic emulsion of the present invention, gelatin is useful, and other hydrophilic colloids may be also used.

For example, proteins, such as a gelatin derivative, a graft polymer of gelatin with other polymer, albumin, and casein; cellulose derivatives, such as hydroxyethyl cellulose, carboxymethylcellulose, and cellulose sulfate ester; saccharide derivatives, such as sodium alginate and starch derivatives; and various synthetic hydrophilic polymers including homopolymers and copolymers, such as a polyvinyl alcohol, a polyvinyl alcohol partial acetal, a poly-N-vinyl pyrrolidone, a polyacrylic acid, a polymethacrylic acid, a polyacrylamide, a polyvinyl imidazole, and a polyvinyl pyrazole, can be mentioned.

As a gelatin, in addition to lime-processed gelatin, an acid-processed gelatin and an enzyme-processed gelatin, as described in *Bull. Soc. Sci. Photo. Japan.* No. 16, p. 30 (1966), can be used, and a hydrolysate or an enzymolyte of gelatin can be used as well. As a gelatin derivative, one obtained by reacting gelatin with various compounds, for example an acid halide, an acid anhydride, isocyanates, a bromoacetic acid, alkane sultones, vinyl sulfonamides, maleic imide compounds, polyalkyleneoxides, and epoxy compounds, can be used.

As a dispersion medium used in the present invention, specific examples are described in paragraph IX of *Research Disclosure*, Volume 176, No. 17643 (December 1978).

The photographic emulsion used in the present invention is spectrally sensitized with methine dyes or the like in view of preferable exhibition of the effect of the present invention. The dyes that will be used include cyanine dyes, merocyanine dyes, composite cyanine dyes, composite merocyanine dyes, halopolar cyanine dyes, hemicyanine dyes, styrylcyanine dyes, and hemioxonol dyes. Particularly useful dyes are cyanine dyes. In these dyes, any nucleus that is generally used in cyanine dyes as a basic heterocyclic nucleus can be used. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; nucleuses formed by fusing an cycloaliphatic hydrocarbon ring to these nucleuses; and nucleuses formed by fusing an aromatic hydrocarbon ring to these nucleuses, i.e., an indolenine nucleus, a benzoindolenine nucleus, an indole nucleus, a benzoxazole nucleus, a naphthooxazole nucleus, a benzothiazole nucleus, a naphthothiazole nucleus, a benzoselenazole nucleus, a benzoimidazole nucleus, and a quinoline nucleus, can be applied. These nucleuses may have a substituent on the carbon atom.

Preferable silver halide to be contained in the photographic emulsion layer of the photosensitive material utilized in the present invention is silver iodobromide, silver iodochloride, and silver iodochlorobromide, containing about 30 mol % or less silver iodide. A particularly preferable silver halide is silver iodobromide and silver iodochlorobromide, containing about 2 to about 10 mol % silver iodide.

The silver halide grains in the photographic emulsion may have a regular crystal form, such as a cubic shape, an octahedral shape, and a tetradecahedral shape, or a irregular crystal shape, such as spherical shape or a tabular shape, or they may have a crystal defect, such as twin planes, or they may have a composite crystal form.

The silver halide grains may be fine grains having a diameter of about 0.2 μm or less, or large-size grains with the diameter of the projected area being down to about 10 μm. As the silver halide emulsion, a polydisperse emulsion or a monodisperse emulsion can be used.

The silver halide photographic emulsions that can be used in the present invention may be prepared suitably by known means, for example, by the methods described in *I. Emulsion Preparation and Types*, in *Research Disclosure* (RD) No. 17643 (December 1978), pp. 22–23, and ibid. No. 18716 (November 1979), p. 648, and ibid. No. 307105 (November, 1989), pp. 863–865; the methods described in P. Glafkides, *Chimie et Phisigue Photographigue*, Paul Montel (1967), in G. F. Duffin, *Photographic Emulsion Chemistry*, Focal Press (1966), and in V. L. Zelikman et al., *Making and Coating of Photographic Emulsion*, Focal Press (1964).

A monodisperse emulsion, such as described in U.S. Pat. Nos. 3,574,628 and 3,655,394, and in British Patent No. 1,413,748, is also preferable.

The above-described emulsion may be any of a surface latent image-type emulsion, wherein a latent image is mainly formed on the grain surface; an internal latent image-type emulsion, wherein a latent image is formed inside the grain; and another type of emulsion, wherein a latent image is formed both on the grain surface and inside the grain; but in any case the above-described emulsion must be a negative-working emulsion. The internal latent image-type emulsion may be a core/shell-type emulsion, as described in JP-A No. 264740/1988. A method of preparing the core/shell-type, internal latent image-type emulsion is described in JP-A No. 133542/1984. The thickness of shells of the core/shell grains is different due to such conditions as the development process, but preferably it is from 3 nm to 40 nm, and most preferably from 5 to 20 nm.

Silver halide grains whose surface was previously fogged, as described in U.S. Pat. No. 4,082,553; silver halide grains whose internal portion was previously fogged, as described in U.S. Pat. No. 4,626,498 and JP-A No. 214852/1984, or a colloidal silver, may be preferably added to a light-sensitive silver halide emulsion layer and/or a substantially non-light-sensitive hydrophilic colloid layer. The silver halide grains whose inside or surface was previously fogged means silver halide grains that are developable uniformly (non-image wise) without a distinction of an unexposed part and an exposed part of the photosensitive material. A method of preparing silver halide grains whose inside or surface is previously fogged is described in U.S. Pat. No. 4,626,498 and JP-A No. 214852/1984.

Silver halides that form internal nuclei of the core/shell-type silver halide grains whose inside is previously fogged may be those having the same halogen composition or those having different halogen compositions. As a silver halide whose grain inside or surface is previously fogged, any of silver chloride, silver chlorobromide, silver iodobromide, and silver chloroiodobromide can be used. Sizes of these previously fogged silver halide grains are not limited in particular, but an average grain size thereof is preferably from 0.01 μm to 0.75 μm, and most preferably from 0.05 μm to 0.6 μm. Further, a grain shape is not limited in particular, and grains may be regular in shape. Moreover, these emulsions may be a poly-dispersion emulsion, but a monodispersion emulsion (at least 95% of silver halide grains in weight or number have grain diameters within ±40% of the average grain diameter) is preferred.

In the present invention, it is preferable to use a light-insensitive fine-grain silver halide. A light-insensitive fine-grain silver halide means silver halide fine particles that are not sensitive to light at an image-wise exposure to light for obtaining a dye image, and that are not substantially developable in a developing process. Preferably these silver halide grains are not previously fogged.

These fine-grain silver halides are those having a silver bromide content of from 0 mol % to 100 mol %; they may optimally contain silver chloride and/or silver iodide. Preferably they contain 0.5 mol % to 10 mol % of silver iodide.

The average grain size (the average diameter of a circle having the same area as the projected area of the grains) of fine-grain silver halides is preferably from 0.01 μm to 0.5 μm, and more preferably from 0.02 μm to 2 μm.

The coating silver amount of the photosensitive material according to the present invention is preferably not more than 6.0 g/m$^2$, and most preferably not more than 4.5 g/m$^2$.

Silver halide emulsions that are used in the present invention are usually subjected to physical ripening, chemical ripening, and spectral sensitization. Additives that are used in such steps are described in Research Disclosures RD No. 17643, RD No. 18716, and RD No. 307105, and they are summarized in the following table.

| Additive | RD 17643 (December 1978) | RD 18716 (November 1979) | RD 307105 (November 1989) |
|---|---|---|---|
| 1 Chemical sensitizer | p. 23 | p. 648 (right column) | p. 866 |
| 2 Sensitivity-enhancing agent | — | p. 648 (right column) | — |
| 3 Spectral sensitizers and Supersensitizers | pp. 23–24 | pp. 648– (right column) 649 (right column) | pp. 866–868 |
| 4 Brightening agents | p. 24 | p. 647 (right column) | p. 868 |
| 5 Antifogging agents and Stabilizers | pp. 24–25 | p. 649 (right column) | pp. 868–870 |
| 6 Light absorbers, Filter dyes, and UV Absorbers | pp. 25–26 | pg. 649– (right column) 650 (left column) | p. 873 |
| 7 Stain-preventing agent | p. 25 (right column) | p. 650 (left to right column) | p. 872 |
| 8 Image dye stabilizers | p. 25 | p. 650 (left column) | p. 872 |
| 9 Hardeners | p. 26 | p. 651 (left column) | pp. 874–875 |
| 10 Binders | p. 26 | p. 651 (left column) | pp. 873–874 |
| 11 Plasticizers and Lubricants | p. 27 | p. 650 (right column) | p. 876 |
| 12 Coating aids and Surface-active agents | pp. 26–27 | p. 650 (right column) | pp. 875–876 |
| 13 Antistatic agents | p. 27 | p. 650 (right column) | pp. 876–877 |
| 14 Matting agent | — | — | pp. 878–879 |

Other techniques and inorganic and organic materials that can be used in the color photosensitive material of the present invention, are described in the below points of Published European Patent Application (EP-A) No. 436, 938A2 and in the below-referred publications.

| | |
|---|---|
| 1. Layer Constitution | p 146 line 34 to p 147 line 25 |
| 2. Yellow coupler | p 137 line 35 to p 146 line 33, p 149 lines 21 to 23 |
| 3. Magenta coupler | p 149 lines 24 to 28; EP-A No. 421,453A2, p 3 line 28 to p 40 line 2 |
| 4. Cyan coupler | p 149 lines 29 to 33; EP-A No. 432,804A2, p 3 line 28 to p 40 line 2 |
| 5. Polymer coupler | p 149 lines 34 to 38; EP-A No. 435,334A2, p 113 line 39 to p 123 line 37 |
| 6. Colored coupler | p 53 line 42 to p 137 line 34, p 149 lines 39 to 45 |
| 7. Other functional coupler | p 7 line 1 to p 53 line 41, p 149 line 46 to p 150 line 3; EP-A No. 435,334A2, p 3 line 1 to p 29 line 50 |
| 8. Antiseptic and mildewproofing agent | p 150 lines 25 to 28 |
| 9. Formalin scavenger | p 149 lines 15 to 17 |
| 10. Other additives | p 153 lines 38 to 47; EP-A No. 421,453Al, p 75 line 21 to p 84 line 56, p 27 line 40 to p 37 line 40 |
| 11. Dispersion method | p 150 lines 4 to 24 |
| 12. Support | p 150 lines 32 to 34 |
| 13. Thickness and physical properties of membrane | p 150 lines 35 to 49 |
| 14. Color development process | p 150 line 50 to p 151 line 47 |
| 15. Desilvering process | p 151 line 48 to p 152 line 53 |
| 16. Automatic processor | p 152 line 54 to p 153 line 2 |
| 17. Water washing and stabilizing process | p 153 lines 3 to 37 |

According to the present invention, a silver halide photosensitive material having high sensitivity and low fog can be obtained.

The present invention will be described by way of its examples, below, but the invention is not limited to them.

EXAMPLE 1

(1) Preparation of Emulsions (Em-1)

A silver iodobromide emulsion containing twin grains (a core/shell ratio=1/2; iodide content of the shell, 2 mol %) having a mean sphere-equivalent diameter of 1.2 μm was prepared by a controlled double jet method in an aqueous gelatin solution, using double twin grains of silver iodobromide having an average iodide content of 20 mol % and a mean sphere-equivalent diameter of 0.8 μm as seed grains.

After this grain formation, the emulsion was subjected to an ordinary desalting and washing steps, and then it was redispersed under the conditions of 40° C. pAg 8.9, and pH 6.3. Further, a gold and sulfur-sensitized emulsion was prepared using sodium thiosulfate and chloroauric acid. The thus obtained emulsion was named Em-1.

(Em-2)

Em-2 was prepared in the same manner as Em-1 was, except for adding $3\times10^{-5}$ mol/mol Ag of the thiosulfonic acid compound, as illustrated below, at the step of one minute before the start of shell formation in Em-1, and adding $1\times10^{-5}$ mol/mol Ag of dimethylamine borane as a reduction sensitizer at the step of one minute after the start of shell formation.

Thiosulfonic acid compound $C_2H_2SO_2SNa$ (Em-3)

Em-3 was prepared in the same manner as Em-2, except that after the steps of a desalting, a washing, and a redispersion in the preparation of Em-2, $5\times10^{-5}$ mol per mol of Ag of the compound (A-4) according to the present invention was added to Em-2, and then the emulsion was subjected to the gold and sulfur sensitization.

An emulsion layer and a protective layer were coated on an undercoated triacetylcellulose support in the coated amount shown in Table 2, to prepare Samples 1001 to 1003 containing Em-1 to Em-3, respectively.

TABLE 2

| Conditions of Emulsion Coating |
|---|
| (1) Emulsion layer |
| • Emulsion |

TABLE 2-continued

| Conditions of Emulsion Coating | |
|---|---|
| Emulsion Em1 to Em3 | (Silver $2.1 \times 10^{-2}$ mol/m$^2$) |
| • Coupler | ($1.5 \times 10^{-3}$ mol/m$^2$) |

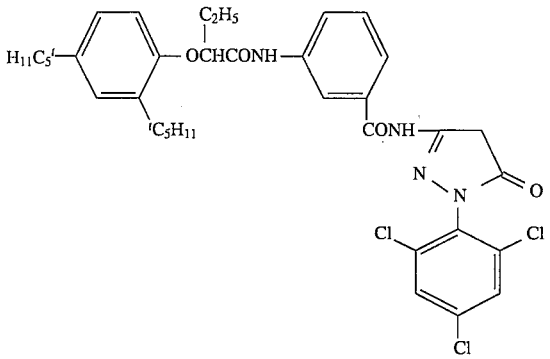

| | |
|---|---|
| • Tricresyl phosphate | (1.10 g/m$^2$) |
| • Gelatin | (2.30 g/m$^2$) |
| (2) Protective layer | |
| • 2,4-dichlorotriazine-6-hydroxy-s-triazine sodium salt | (0.08 g/m$^2$) |
| • Gelatin | (1.80 g/m$^2$) |

Each of these samples was exposed to light at color temperature 4,800° K. through a continuous wedge for 1/100 sec. for sensitometry and developed according to the following color-developing process. The developing process herein used was performed at 38° C. under the conditions described below.

(Processing process)

| Processing step | Time | Temperature | Replenisher* | Tank Volume |
|---|---|---|---|---|
| Color developing | 2 min 45 sec | 38° C. | 33 ml | 20 liter |
| Bleaching | 6 min 30 sec | 38° C. | 25 ml | 40 liter |
| Water washing | 2 min 10 sec | 24° C. | 1200 ml | 20 liter |
| Fixing | 4 min 20 sec | 38° C. | 25 ml | 30 liter |
| Water washing (1) | 1 min 05 sec | 24° C. | Counter-current piping mode from (2) to (1) | 10 liter |
| Water washing (2) | 1 min 00 sec | 24° C. | 1200 ml | 10 liter |
| Stabilizing (3) | 1 min 05 sec | 38° C. | 25 ml | 10 liter |
| Drying | 4 min 20 sec | 55° C. | | |

Note: *Replenisher amount per one meter length of 35 mm width.

The composition of each processing solution is shown below.

| | Mother Solution (g) | Replenisher (g) |
|---|---|---|
| (Color-developer) | | |
| Diethylenetriaminepentaacetic acid | 1.0 | 1.1 |
| 1-hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5mg | — |
| Hydroxylamine sulfate | 2.4 | 2.8 |
| 4-[N-Ethyl-N-β-hydroxyethylamino]-2-methylaniline sulfate | 4.5 | 5.5 |
| Water to make | 1.0 liter | 1.0 liter |
| pH | 10.05 | 10.10 |
| (Bleaching solution) | | |
| Iron (III) sodium ethylenediamine-tetraacetate trihydrate | 100.0 | 120.0 |
| Disodium ethylenediamine-tetraacetate | 10.0 | 11.0 |
| Ammonium bromide | 140.0 | 160.0 |
| Ammonium nitrate | 30.0 | 35.0 |
| Aqueous ammonia (27%) | 6.5 ml | 4.0 ml |
| Water to make | 1.0 liter | 1.0 liter |
| pH | 6.0 | 5.7 |
| (Fixing solution) | | |
| Sodium ethylenediaminetetraacetate | 0.5 | 0.7 |
| Sodium sulfite | 7.0 | 8.0 |
| Sodium bisulfite | 5.0 | 5.5 |
| Aqueous ammonium thiosulfite solution (70%) | 170.0 ml | 200.0 ml |
| Water to make | 1.0 liter | 1.0 liter |
| pH | 6.7 | 6.6 |
| (Stabilizing solution) | | |
| Formalin (37%) | 2.0 ml | 3.0 ml |
| Polyoxyethylene-p-monononylphenyl ether (average polymerization degree: 10) | 0.3 | 0.45 |
| Disodium ethylenediaminetetraacetate | 0.05 | 0.08 |
| Water to make | 1.0 liter | 1.0 liter |
| pH | 5.8–8.0 | 5.8–8.0 |

The optical density of each processed sample was measured by using a green filter.

The sensitivity was shown as a relative value in logarithm of exposure that gives an optical density of 0.2 higher than fog.

The thus obtained results are shown in Table 3.

TABLE 3

| Sample | Reduction sensitizer (Dimethylamine borane) (mol/mol Ag) | Radical scavenger (Compound A-4) (mol/mol Ag) | Thiosulfonic acid ($C_2H_5SO_2SNa$) (mol/mol Ag) | Sensitivity | Fog | Remarks |
|---|---|---|---|---|---|---|
| 1001 | — | — | — | 100 | 0.20 | Comparative Example |
| 1002 | $3 \times 10^{-5}$ | — | $1 \times 10^{-5}$ | 132 | 0.25 | Comparative Example |
| 1003 | $3 \times 10^{-5}$ | $5 \times 10^{-4}$ | $1 \times 10^{-5}$ | 157 | 0.18 | This invention |

Higher sensitivity is obtained by the addition of a combination of thiosulfonic acid and dimethylamine borane as a reduction sensitizer (JP-A No. 191938/1990). Much higher sensitivity is obtained by further adding thereto a compound of the present invention. Moreover, at this time, the degree of fog formed in the emulsion of the present invention is the same level as those of emulsions prior to reduction sensitization. Therefore it is found that an emulsion having low fog and high sensitivity is obtained by the present invention.

EXAMPLE 2

(1) Preparation of Emulsions (Em-11)

While an aqueous solution obtained by dissolving 6 g of potassium bromide and 30 g of inactive gelatin having an average molecular weight of 15,000 to 3.7 liters of distilled water was agitated, a 14% aqueous potassium bromide solution and a 20% aqueous silver nitrate solution were added to the above aqueous solution by a double jet method at constant flow rates, over one minute, under the conditions of 55° C. and a pBr of 1.0 (in this addition, 2.4% of a total silver amount was consumed).

Then, an aqueous gelatin solution (17%, 300 cc) was added to the resultant mixture, and the solution was agitated at 55° C. Thereafter, a 20% aqueous silver nitrate solution was added to the mixture at a constant flow rate until the pBr reached 1.4 (in this addition, 5.0% of the total silver amount was consumed). At this time, thiourea dioxide was added to a reaction vessel, in an amount of $1.2\times10^{-5}$ mol per 1 mol of silver. A 20% aqueous potassium iodobromide solution ($KBr_{1-x}I_x$:x=0.04) and a 33% aqueous silver nitrate solution were further added to the resultant mixture by the double jet method, over 43 minutes (in this addition, 50% of the total silver amount was consumed). At this time, an aqueous solution containing 8.3 g of potassium iodide was added to the resultant mixture. After that, 14.5 ml of a 0.001 weight % aqueous $K_3IrCl_6$ solution was added, and then a 20% aqueous potassium bromide solution and a 33% aqueous silver nitrate solution were added to the resultant mixture by the double jet method, over 39 minutes (in this addition, 42.6% of the total silver amount was consumed; the thiosulfonic acid compound as described in Example 1 in an amount of $1.2\times10^{-4}$ mol per 1 mol of Ag was added at 10 minutes after the start of this final shell formation). The amount of silver nitrate used for this emulsion was 425 g. Then, after a desalting according to an ordinary flocculation, the emulsion was adjusted to a pAg of 8.2 and a pH of 5.8° at 40° C. A tabular silver iodobromide emulsion having an average aspect ratio of 6.5, a variation coefficient of 18%, and a sphere-equivalent diameter of 0.8 μm, was prepared. From observation using a transmission electron microscope with a voltage of 200 kv at a liquid nitrogen temperature, it was identified that an average 50 or more of dislocation lines per 1 grain existed in the vicinity of the outer surface of tabular grains.

To the thus obtained emulsion, were added $4\times10^{-4}$ mol/mol Ag of the sensitizing dye A, $2\times10^{-5}$ mol/mol Ag of the sensitizing dye B, and $6\times10^{-4}$ mol/mol Ag of the sensitizing dye C, each of which is shown in Table 4, and then this emulsion was optimally gold-selenium-sulfur sensitized with sodium thiosulfate and chloroauric acid, N,N-dimethylselenourea and potassium thiocyanate, whereby Em-11 was prepared.

TABLE 4

Sensitizing dye A

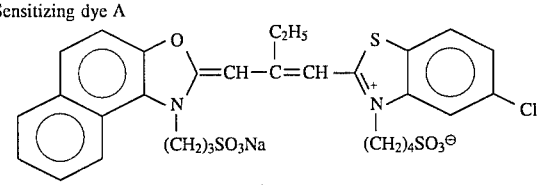

Sensitizing dye B

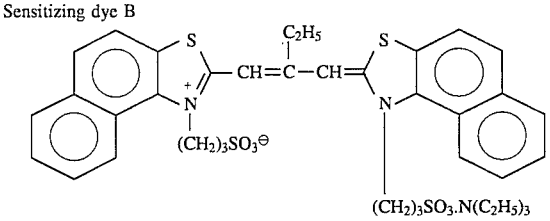

Sensitizing dye C

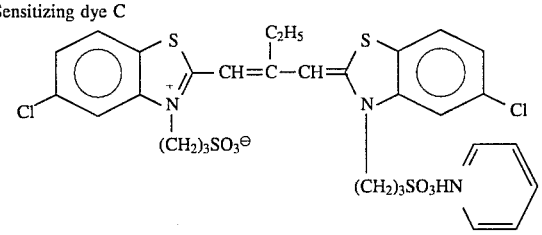

(Em-12)

In the preparation of Em-11, $3.3\times10^{-4}$ mol/mol Ag of Compound A-4 according to the present invention was added at 11 minutes after the start of the final shell formation.

(Em-13)

In the preparation of Em-11, $3.3\times10^{-4}$ mol/mol Ag of Compound A-4 according to the present invention was added just before the water washing.

(Em-14)

In the preparation of Em-11, $3.3\times10^{-4}$ mol/mol Ag of Compound A-4 according to the present invention was added before the addition of sensitizing dyes.

(Em-15)

In the preparation of Em-11, $3.3\times10^{-4}$ mol/mol Ag of Compound A-4 according to the present invention was added after the completion of chemical sensitization.

(Em-16)

In the preparation of Em-11, $3.3\times10^{-4}$ mol/mol Ag of Compound A-3 according to the present invention was added before the addition of the sensitizing dyes.

(Em-17)

In the preparation of Em-11, $3.3\times10^{-4}$ mol/mol Ag of Compound A-1 according to the present invention was added before the addition of the sensitizing dye.

(Em-18)

In the preparation of Em-11, $3.3\times10^{-5}$ mol/mol Ag of Compound A-1 according to the present invention was added before the addition of the sensitizing dyes.

(Em-19)

In the preparation of Em-11, $3.3\times10^{-3}$ mol/mol Ag of Compound A-1 according to the present invention was added before the addition of the sensitizing dyes.

An emulsion layer and a protective layer were coated on an undercoated triacetylcellulose support in the same manner as in Example 1, to prepare samples 1011 to 1019 containing Em-11 to Em-19, respectively. These samples 1011 to 1019 were exposed to light and developed in the same manner as in Example 1.

The thus obtained results are shown in Table 5.

TABLE 5

| Sample No. | Reduction sensitizer (Thiourea dioxide) (mol/mol Ag) | Thiosulfonic acid (mol/mol Ag) | Radical scavenger Compound | Radical scavenger Added amount (mol/mol Ag) | Radical scavenger Added timing | Sensitivity | Fog | Remarks |
|---|---|---|---|---|---|---|---|---|
| 1011 | $1.2\times10^{-5}$ | $1.2\times10^{-4}$ | — | — | — | 100 | 0.28 | Comparative Example |
| 1012 | $1.2\times10^{-5}$ | $1.2\times10^{-4}$ | A-4 | $3.3\times10^{-4}$ | at 11 min after start of final shell formation | 120 | 0.28 | This Invention |
| 1013 | $1.2\times10^{-5}$ | $1.2\times10^{-4}$ | A-4 | $3.3\times10^{-4}$ | just before water washing | 123 | 0.28 | This Invention |
| 1014 | $1.2\times10^{-5}$ | $1.2\times10^{-4}$ | A-4 | $3.3\times10^{-4}$ | before addition of sensitizing dyes | 125 | 0.26 | This Invention |
| 1015 | $1.2\times10^{-5}$ | $1.2\times10^{-4}$ | A-4 | $3.3\times10^{-4}$ | after completion of chemical sensitization | 100 | 0.27 | Comparative Example |
| 1016 | $1.2\times10^{-5}$ | $1.2\times10^{-4}$ | A-3 | $3.3\times10^{-4}$ | before addition of sensitizing dyes | 130 | 0.22 | This Invention |
| 1017 | $1.2\times10^{-5}$ | $1.2\times10^{-4}$ | A-1 | $3.3\times10^{-4}$ | before addition of sensitizing dyes | 125 | 0.26 | This Invention |
| 1018 | $1.2\times10^{-5}$ | $1.2\times10^{-4}$ | A-1 | $3.3\times10^{-5}$ | before addition of sensitizing dyes | 115 | 0.28 | This Invention |
| 1019 | $1.2\times10^{-5}$ | $1.2\times10^{-4}$ | A-1 | $3.3\times10^{-3}$ | before addition of sensitizing dyes | 120 | 0.28 | This Invention |

As is apparent from Table 5, samples 1012 to 1014 and 1016 to 1019 of the present invention each provide a considerable enhancement of sensitivity without increasing fog formation, in comparison with Sample 1011, which does not contain any compound according to the present invention. On the other hand, no increase in sensitivity was observed with respect to sample 1015, wherein a compound according to the present invention was added after the completion of chemical sensitization.

EXAMPLE 3

(Sample 101)

A multilayer color photosensitive material, sample 101, was prepared by multi-coating respective layers having compositions shown below on undercoated triacetate cellulose film support. (Composition of photosensitive layer)

Coating amounts for silver halide and colloidal silver are represented by g/m$^2$ in terms of silver; coating amounts for coupler, additive, and gelatin are represented by g/m$^2$, and coating amounts for sensitizing dye are shown in mol per mol of silver halide of the same layer. Symbols representing additives have the meanings shown below, provided that for additives having plural functions one function is described as a representative of the functions.

UV; Ultraviolet-rays absorber
Solv; High-boiling organic solvent
ExF; Dye
ExS; Sensitizing dye
ExC; Cyan coupler
ExM; Magenta coupler
ExY; Yellow coupler
Cpd; Additive

| First Layer (Halation-preventing Layer) | |
|---|---|
| Black colloidal silver | 0.15 |
| Gelatin | 2.33 |
| UV-1 | $3.0\times10^{-2}$ |
| UV-2 | $6.0\times10^{-2}$ |
| UV-3 | $7.0\times10^{-2}$ |

-continued

| | |
|---|---|
| ExF-1 | $1.0\times10^{-2}$ |
| ExF-2 | $4.0\times10^{-2}$ |
| ExF-3 | $5.0\times10^{-3}$ |
| ExM-3 | 0.11 |
| Cpd-5 | $1.0\times10^{-3}$ |
| Solv-1 | 0.16 |
| Solv-2 | 0.10 |
| **Second Layer (Low Sensitivity Red-sensitive Emulsion Layer)** | |
| Silver iodobromide emulsion A Silver coating amount | 0.35 |
| Silver iodobromide emulsion B Silver coating amount | 0.18 |
| Gelatin | 0.77 |
| ExS-1 | $6.5\times10^{-4}$ |
| ExS-2 | $3.6\times10^{-4}$ |
| ExS-5 | $6.2\times10^{-4}$ |

-continued

| | |
|---|---|
| ExS-7 | $4.1 \times 10^{-6}$ |
| ExC-1 | $9.0 \times 10^{-2}$ |
| ExC-2 | $5.0 \times 10^{-3}$ |
| ExC-3 | $4.0 \times 10^{-2}$ |
| ExC-5 | $8.0 \times 10^{-2}$ |
| ExC-6 | $2.0 \times 10^{-2}$ |
| ExC-9 | $2.5 \times 10^{-2}$ |
| Cpd-1 | $2.2 \times 10^{-2}$ |
| Third Layer (Medium Sensitivity Red-sensitive Emulsion Layer) | |
| Silver iodobromide emulsion C Silver coating amount | 0.55 |
| Gelatin | 1.46 |
| ExS-1 | $4.3 \times 10^{-4}$ |
| ExS-2 | $2.4 \times 10^{-4}$ |
| ExS-5 | $4.1 \times 10^{-4}$ |
| ExS-7 | $4.3 \times 10^{-6}$ |
| ExC-1 | 0.19 |
| ExC-2 | $1.0 \times 10^{-2}$ |
| ExC-3 | $1.0 \times 10^{-2}$ |
| ExC-4 | $1.6 \times 10^{-2}$ |
| ExC-5 | 0.19 |
| ExC-6 | $2.0 \times 10^{-2}$ |
| ExC-7 | $2.5 \times 10^{-2}$ |
| ExC-9 | $3.0 \times 10^{-2}$ |
| Cpd-4 | $1.5 \times 10^{-2}$ |
| Fourth Layer (High Sensitivity Red-sensitive Emulsion Layer) | |
| Silver iodobromide emulsion D Silver coating amount | 1.05 |
| Gelatin | 1.38 |
| ExS-1 | $3.6 \times 10^{-4}$ |
| ExS-2 | $2.0 \times 10^{-4}$ |
| ExS-5 | $3.4 \times 10^{-4}$ |
| ExS-7 | $1.4 \times 10^{-5}$ |
| ExC-1 | $2.0 \times 10^{-2}$ |
| ExC-3 | $2.0 \times 10^{-2}$ |
| ExC-4 | $9.0 \times 10^{-2}$ |
| ExC-5 | $5.0 \times 10^{-2}$ |
| ExC-8 | $1.0 \times 10^{-2}$ |
| ExC-9 | $1.0 \times 10^{-2}$ |
| Cpd-4 | $1.0 \times 10^{-3}$ |
| Solv-1 | 0.70 |
| Solv-2 | 0.15 |
| Fifthe Layer (Intermediate Layer) | |
| Gelatin | 0.62 |
| Cpd-1 | 0.13 |
| Poly(ethyl acrylate) latex | $8.0 \times 10^{-2}$ |
| Solv-1 | $8.0 \times 10^{-2}$ |
| Sixth Layer (Low Sensitivity Green-sensitive Emulsion Layer) | |
| Silver iodobromide emulsion B Silver coating amount | 0.10 |
| Silver iodobromide emulsion A Silver coating amount | 0.28 |
| Gelatin | 0.31 |
| ExS-4 | $12.8 \times 10^{-4}$ |
| ExS-5 | $2.1 \times 10^{-4}$ |
| ExS-8 | $1.2 \times 10^{-4}$ |
| ExM-1 | 0.12 |
| ExM-7 | $2.1 \times 10^{-2}$ |
| Solv-1 | 0.09 |
| Solv-3 | $7.0 \times 10^{-3}$ |
| Seventh Layer (Medium Sensitivity Green-sensitive Emulsion Layer) | |
| Silver iodobromide emulsion C Silver coating amount | 0.37 |
| Gelatin | 0.54 |
| ExS-4 | $8.5 \times 10^{-4}$ |
| ExS-5 | $1.4 \times 10^{-4}$ |
| ExS-8 | $8.3 \times 10^{-5}$ |
| ExM-1 | 0.27 |
| ExM-7 | $7.2 \times 10^{-2}$ |
| ExY-1 | $5.4 \times 10^{-2}$ |
| Solv-1 | 0.23 |

-continued

| | |
|---|---|
| Solv-3 | $1.8 \times 10^{-2}$ |
| Eighth Layer (High Sensitivity Green-sensitive Emulsion Layer) | |
| Silver iodobromide emulsion D Silver coating amount | 0.53 |
| Gelatin | 0.61 |
| ExS-4 | $7.1 \times 10^{-4}$ |
| ExS-5 | $1.4 \times 10^{-4}$ |
| ExS-8 | $4.6 \times 10^{-5}$ |
| ExM-2 | $5.5 \times 10^{-3}$ |
| ExM-3 | $1.0 \times 10^{-2}$ |
| ExM-5 | $1.0 \times 10^{-2}$ |
| ExM-6 | $3.0 \times 10^{-2}$ |
| ExY-1 | $1.0 \times 10^{-2}$ |
| ExC-1 | $4.0 \times 10^{-3}$ |
| ExC-4 | $2.5 \times 10^{-3}$ |
| Cpd-6 | $1.0 \times 10^{-2}$ |
| Solv-1 | 0.12 |
| Ninth Layer (Intermediate Layer) | |
| Gelatin | 0.56 |
| UV-4 | $4.0 \times 10^{-2}$ |
| UV-5 | $3.0 \times 10^{-2}$ |
| Cpd-1 | $4.0 \times 10^{-2}$ |
| Poly(ethyl acrylate) latex | $5.0 \times 10^{-2}$ |
| Solv-1 | $3.0 \times 10^{-2}$ |
| Tenth Layer (Donner Layer of Interlayer Effect for Red-sensitive Layers) | |
| Silver iodobromide emulsion E Silver coating amount | 0.40 |
| Silver iodobromide emulsion F Silver coating amount | 0.20 |
| Silver iodobromide emulsion G Silver coating amount | 0.39 |
| Gelatin | 0.87 |
| ExS-3 | $9.8 \times 10^{-4}$ |
| ExM-2 | 0.16 |
| ExM-4 | $3.0 \times 10^{-2}$ |
| ExM-5 | $5.0 \times 10^{-2}$ |
| ExY-2 | $2.5 \times 10^{-3}$ |
| ExY-5 | $2.0 \times 10^{-2}$ |
| Solv-1 | 0.30 |
| Solv-5 | $3.0 \times 10^{-2}$ |
| Eleventh Layer (Yellow Filter Layer) | |
| Yellow colloidal silver | $4.2 \times 10^{-2}$ |
| Dye-1 | $1.02 \times 10^{-1}$ |
| Gelatin | 0.84 |
| Cpd-1 | $5.0 \times 10^{-2}$ |
| Cpd-2 | $5.0 \times 10^{-2}$ |
| Cpd-5 | $2.0 \times 10^{-3}$ |
| Solv-1 | 0.13 |
| H-1 | 0.25 |
| Twelfth Layer (Low Sensitivity Blue-sensitive Emulsion Layer) | |
| Silver iodobromide emulsion A Silver coating amount | 0.50 |
| Silver iodobromide emulsion H Silver coating amount | 0.40 |
| Gelatin | 1.75 |
| ExS-6 | $9.0 \times 10^{-4}$ |
| ExY-1 | $8.5 \times 10^{-2}$ |
| ExY-2 | $5.5 \times 10^{-3}$ |
| ExY-3 | $6.0 \times 10^{-2}$ |
| ExY-5 | 1.00 |
| ExC-1 | $5.0 \times 10^{-2}$ |
| ExC-2 | $8.0 \times 10^{-2}$ |
| Solv-1 | 0.54 |
| Thirteenth Layer (Intermediate Layer) | |
| Gelatin | 0.30 |
| ExY-1 | 0.14 |
| Solv-1 | 0.14 |
| Fourteenth Layer (High Sensitivity Blue-sensitive Emulsion Layer) | |
| Silver iodobromide | |

-continued

| | |
|---|---|
| emulsion I Silver coating amount | 0.40 |
| Gelatin | 0.95 |
| ExS-6 | $6.3 \times 10^{-4}$ |
| ExY-2 | $1.0 \times 10^{-2}$ |
| ExY-3 | $2.0 \times 10^{-2}$ |
| ExY-5 | 0.18 |
| ExC-1 | $1.0 \times 10^{-2}$ |
| Solv-1 | $9.0 \times 10^{-2}$ |
| Fifteenth Layer (First Protective Layer) | |
| Fine-grain silver iodobromide emulsion J Silver coating amount | 0.12 |
| Gelatin | 0.63 |
| UV-4 | 0.11 |
| UV-5 | 0.18 |
| Cpd-3 | 0.10 |
| Solv-1 | $2.0 \times 10^{-2}$ |
| Poly(ethyl acrylate) latex | $9.0 \times 10^{-2}$ |
| Sixteenth Layer (Second Protective Layer) | |
| Fine-grain silver iodobromide emulsion J Silver coating amount | 0.36 |
| Gelatin | 0.85 |
| B-1 (diameter 2.0 μm) | $8.0 \times 10^{-2}$ |
| B-2 (diameter 2.0 μm) | $8.0 \times 10^{-2}$ |
| B-3 | $2.0 \times 10^{-2}$ |
| W-5 | $2.0 \times 10^{-2}$ |
| H-1 | 0.18 |

In addition to the above, the thus prepared Sample was added 1, 2-benzisothiazoline-3-one (average 200 ppm to gelatin), n-butyl-p-hydroxybenzoate (average about 1,000 ppm to gelatin), and 2-phenoxyethanol (average about 10,000 ppm to gelatin). Further, in order to improve stability, processing property, pressure resistance, keeping property from mold and fungi, antistatic property, and coating property, besides above-mentioned components, W-1 to W-6, B-1 to B-6, F-1 to F-10, F-13 to F-16 and iron salt, lead salt, gold salt, platinum salt, iridium salt, rhodium salt were optionally contained in all emulsion layers.

TABLE 6

| Emulsion | Average AgI content (mol %) | Average grain diameter (μm) | Diviation coefficient concerning grain diameter (%) | Ratio of diameter/ thickness | Structure of grains |
|---|---|---|---|---|---|
| A | 3.0 | 0.28 | 23 | 4.5 | Tabular grains |
| B | 3.0 | 0.35 | 25 | 5.6 | Tabular grains |
| C | 8.8 | 0.53 | 22 | 5.5 | Tabular grains |
| D | 8.8 | 0.67 | 26 | 6.0 | Tabular grains |
| E | 2.5 | 0.28 | 21 | 4.8 | Tabular grains |
| F | 3.5 | 0.60 | 23 | 5.2 | Tabular grains |
| G | 3.4 | 0.53 | 25 | 5.8 | Tabular grains |
| H | 8.8 | 0.62 | 26 | 6.0 | Tabular grains |
| I | 8.8 | 0.75 | 26 | 6.5 | Tabular grains |
| J | 2.0 | 0.07 | 15 | 1.0 | Uniform structure, fine grains |

In Table 6:

(1) Emulsions A to I were subjected to reduction sensitization using thiourea dioxide and thiosulfonic acid in accordance with Examples given in JP-A No. 191938/1990 when the grains were prepared.

(2) In the preparation of tabular grains, low-molecular weight gelatins were used in accordance with Examples given in JP-A No. 158426/1989.

(3) Dislocation lines as described in JP-A No. 237450/1991 were observed in the tabular grains under a high-voltage electron microscope.

(4) Emulsions A to N contained iridium inside of grain by the method described, for example, in B. H. Carroll, Photographic Science and Engineering, 24, 265 (1980).

Compounds added to the layers are shown below.

UV-1
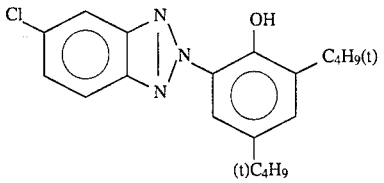
UV-2
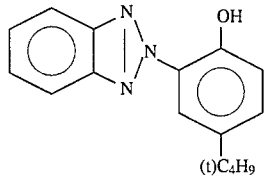
UV-3
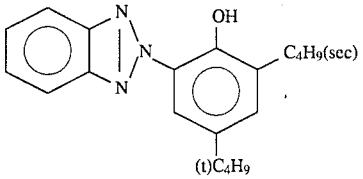
UV-4
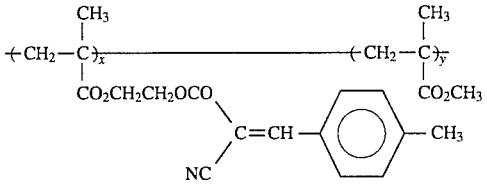
x:y = 70:30 (wt %)
UV-5
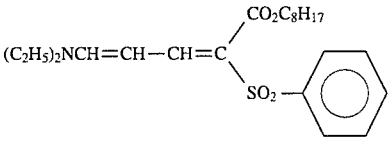
ExF-1
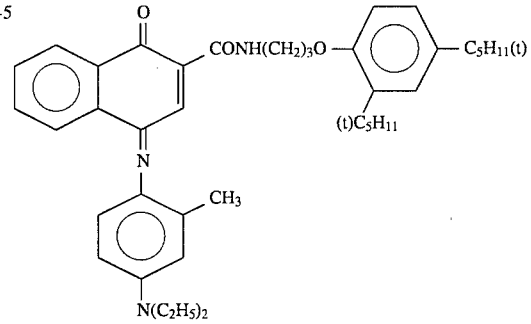
ExF-2
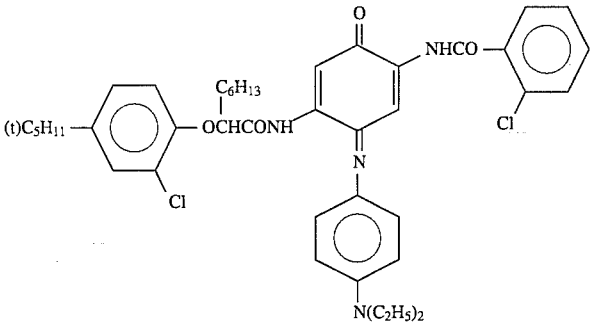
EXF-3
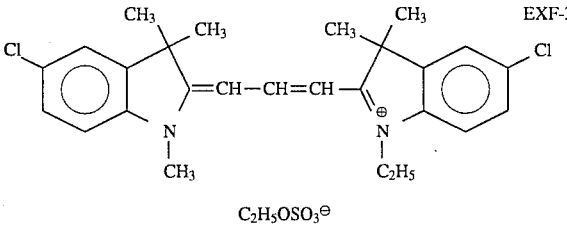
ExC-1
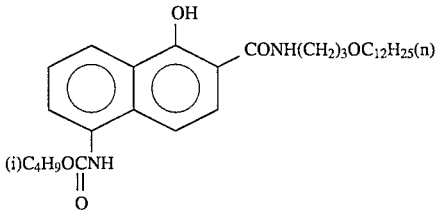

-continued
ExC-2
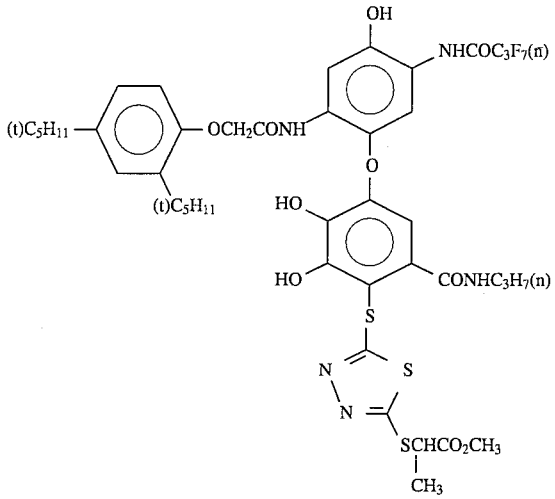
ExC-3
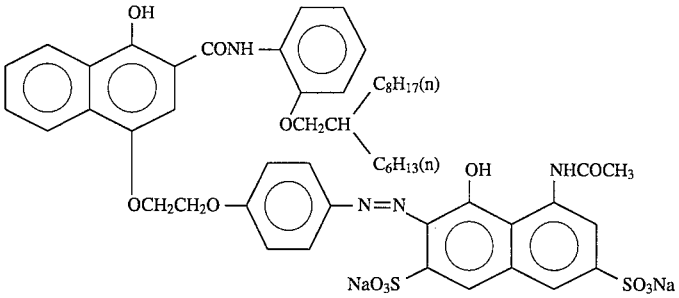
ExC-4
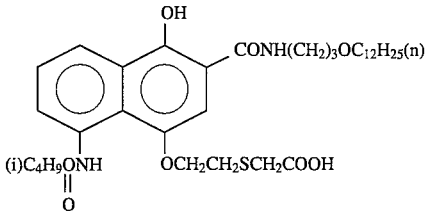
ExC-5
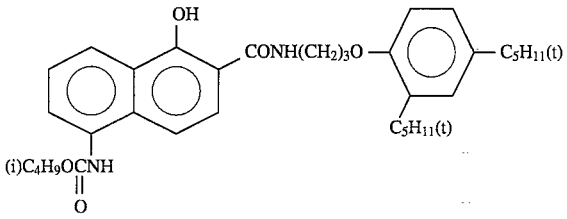
ExC-6
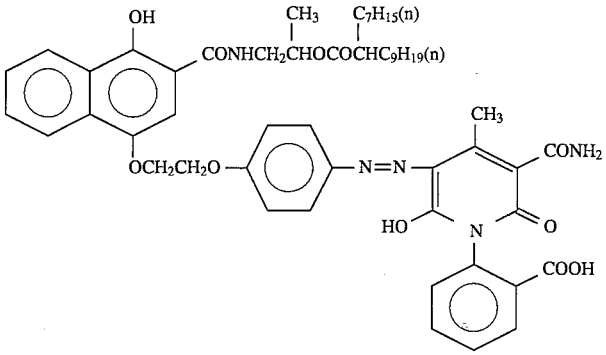

-continued
ExC-7
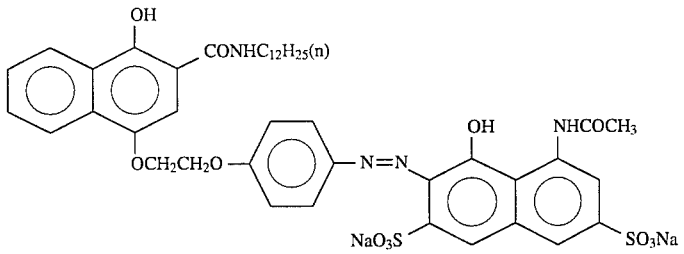
ExC-8
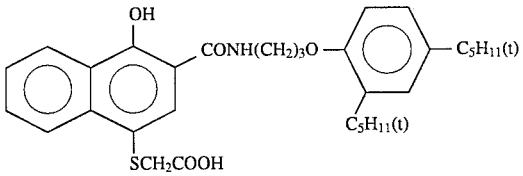
ExC-9
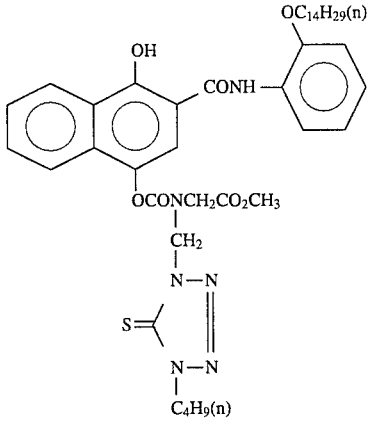
ExM-1
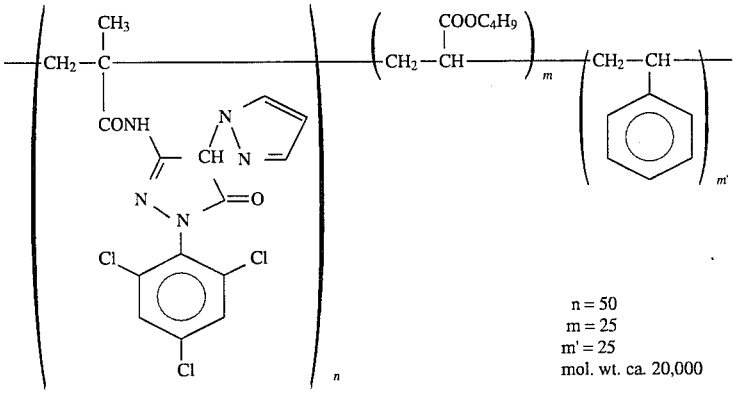
ExM-2
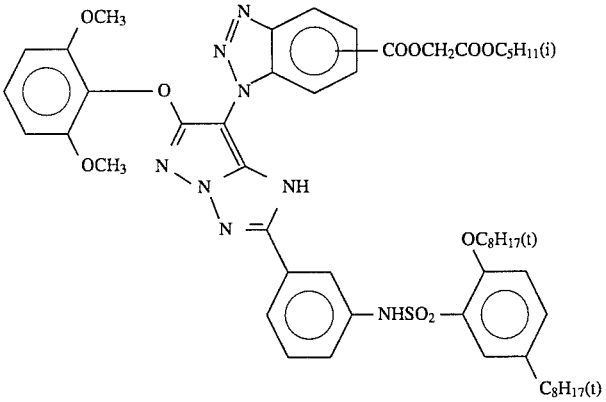

-continued
ExM-3
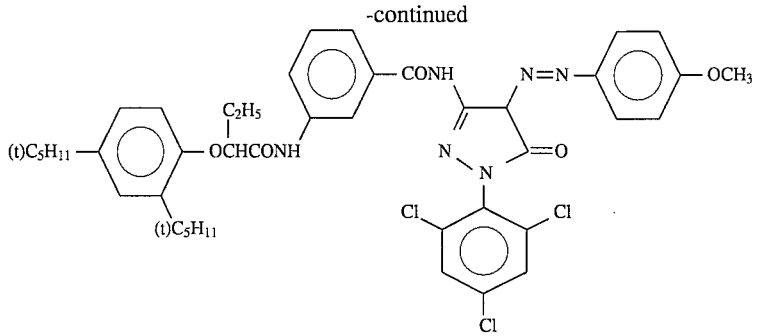
ExM-4
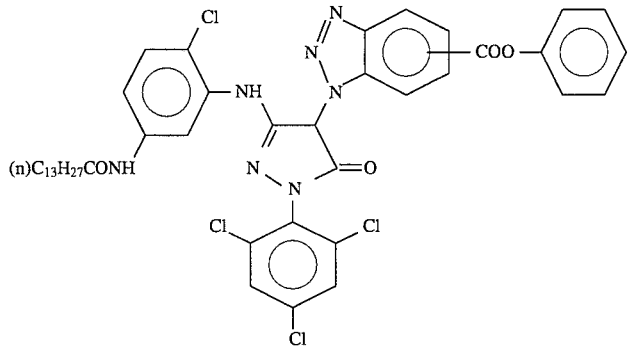
ExM-5
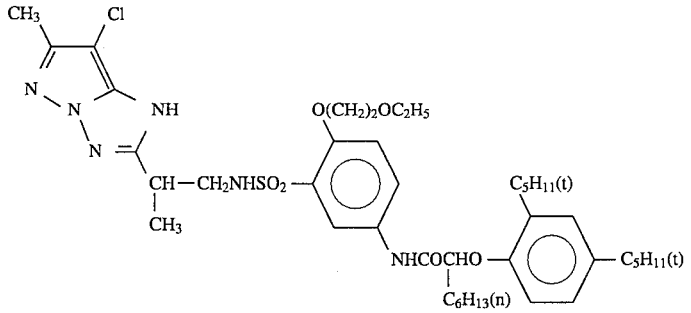
EXM-6
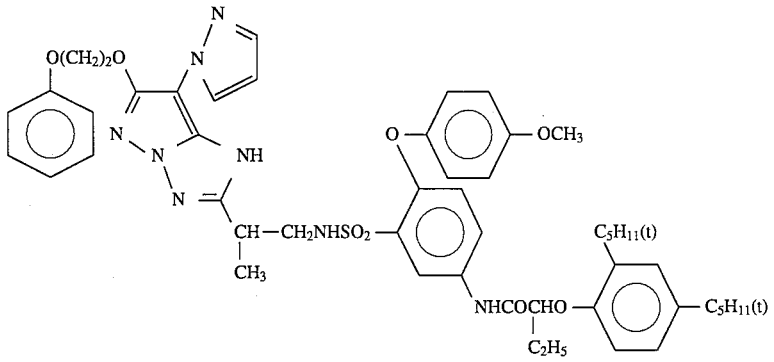
ExM-7
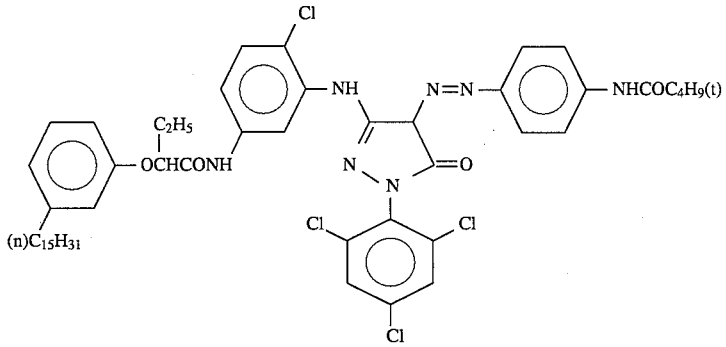

-continued
ExY-1
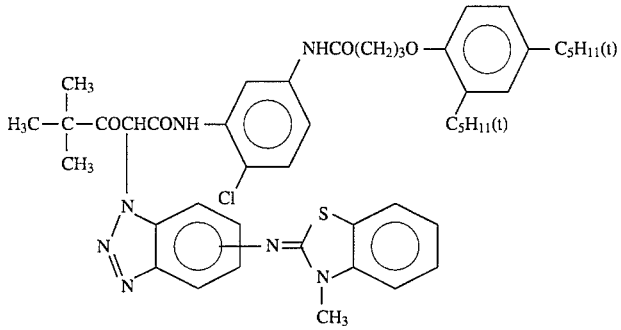
ExY-2
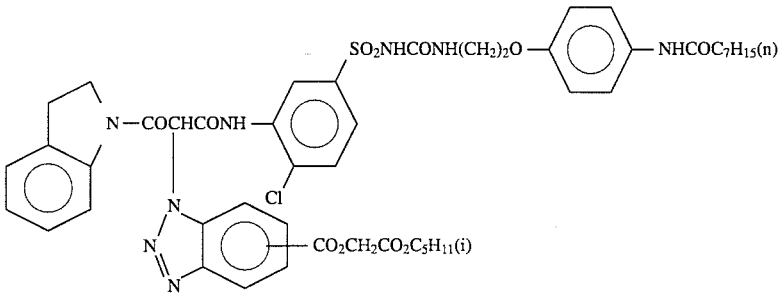
ExY-3
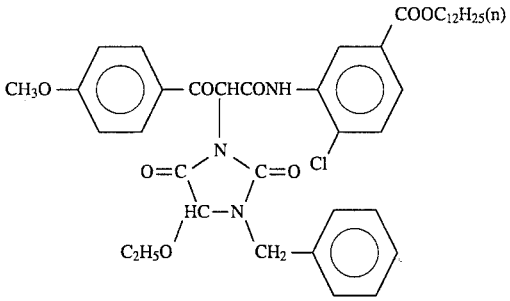
ExY-4
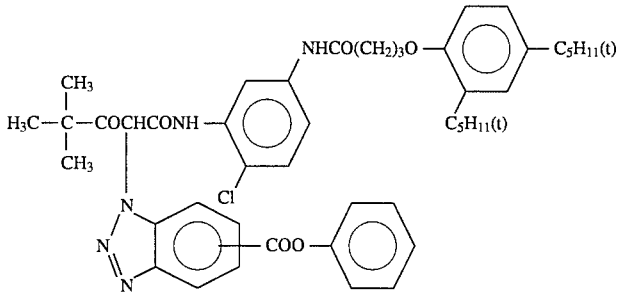
ExY-5
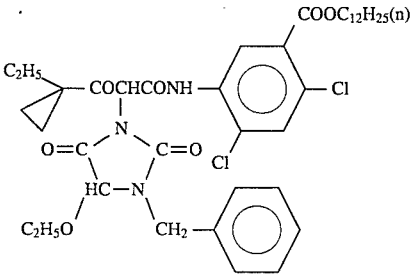
Cpd-1
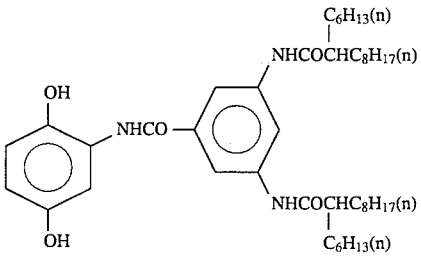
Cpd-2
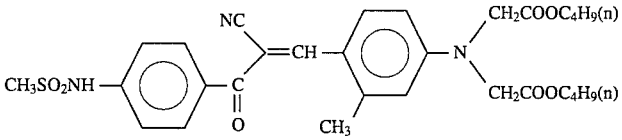

-continued
Cpd-3
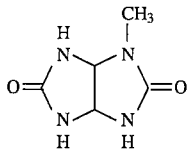
Cpd-4
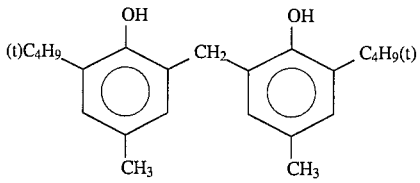
Cpd-5
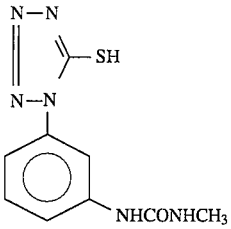
Cpd-6
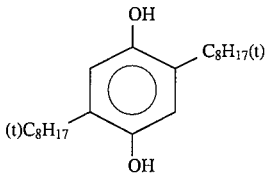
Solv-1
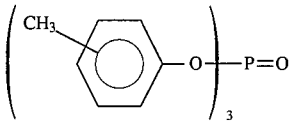
Solv-2
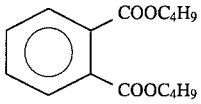
Solv-3
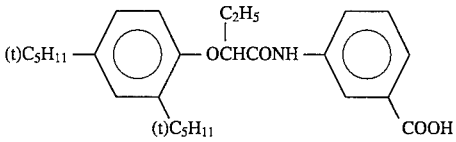
Solv-4
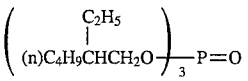
Solv-5
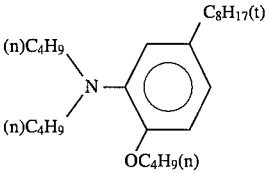
ExS-1
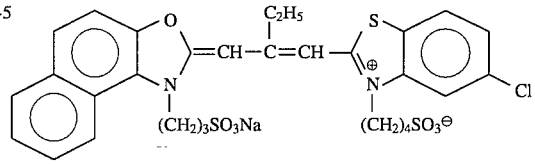
ExS-2
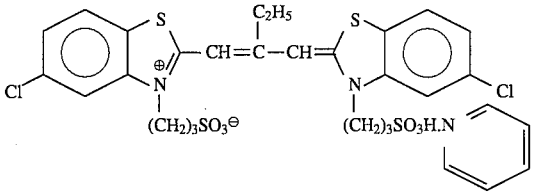
ExS-3
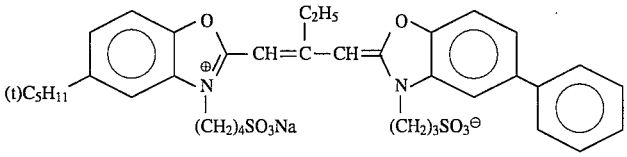
ExS-4
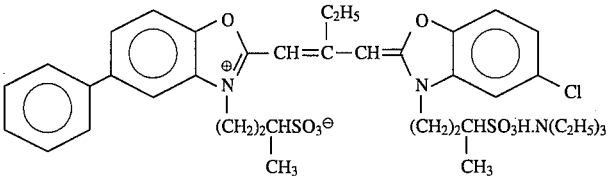
ExS-5
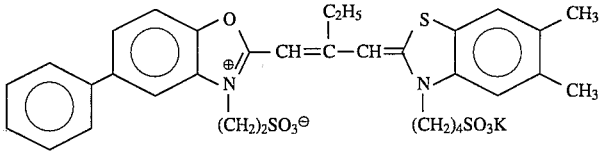

-continued
ExS-6
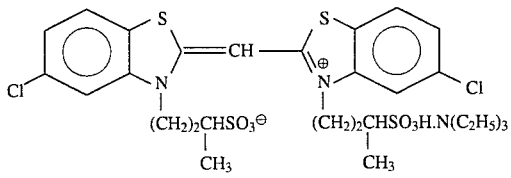
ExS-7
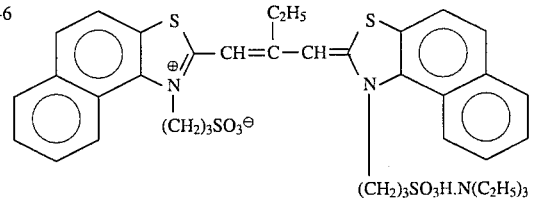
ExS-8
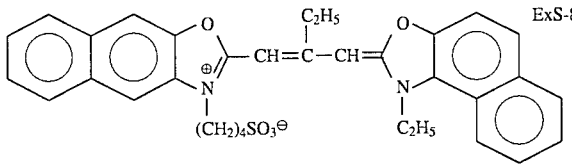
H-1
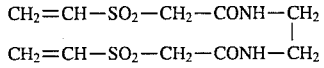
W-1
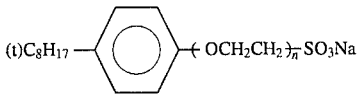
n = 2 ~ 4
W-2
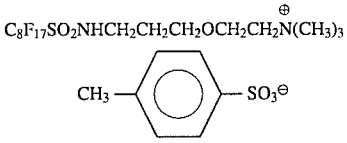
W-3
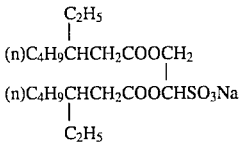
W-4
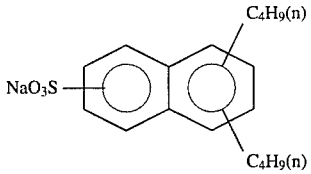
W-5
$C_8F_{17}SO_2N(C_3H_7)CH_2COOK$
W-6
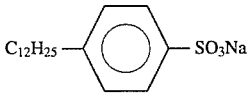
B-1
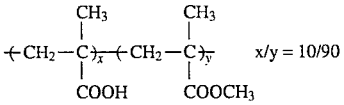
x/y = 10/90
B-2
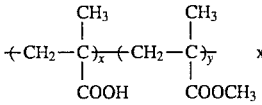
x/y = 40/60
B-3
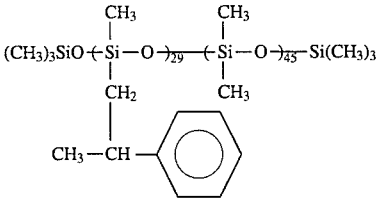
B-4
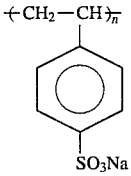
B-5
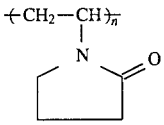
(mol. wt. ca. 10,000)
B-6
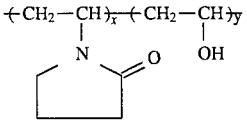
x/y = 70/30
F-1
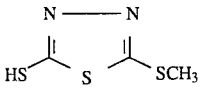
F-2
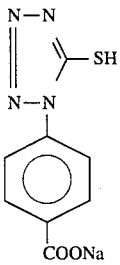

-continued

F-3

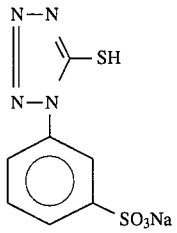

F-4

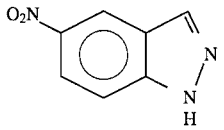

F-5

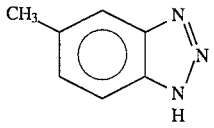

F-6

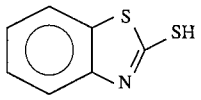

F-7

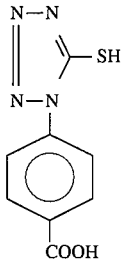

F-8

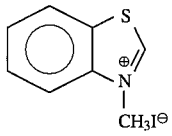

F-9

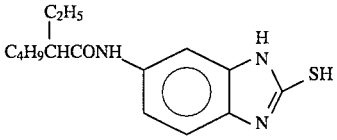

F-10

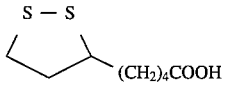

F-13

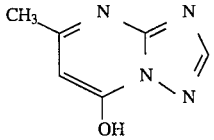

F-14

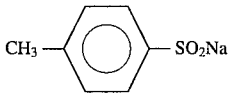

F-15

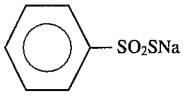

F-16

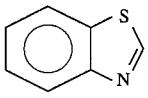

DYE-1

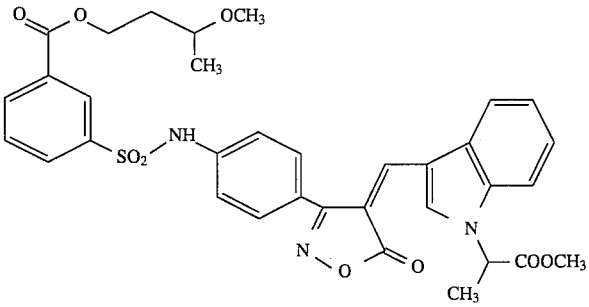

(Sample 102)

In the preparation of Sample 101, $3\times10^{-4}$ mol/mol Ag of Compound (A-3) according to the present invention was added in each emulsion layer.

(Sample 103)

In the preparation of Sample 101, $6\times10^{-4}$ mol/mol Ag of Compound (A-3) according to the present invention was added in each emulsion layer.

(Sample 104)

In the preparation of Sample 101, $3\times10^{-4}$ mol/mol Ag of Compound (A-3) according to the present invention was added in emulsions A to I, respectively, before chemical sensitization of the emulsions.

(Sample 105)

In the preparation of Sample 104, $3\times10^{-4}$ mol/mol Ag of Compound (A-3) according to the present invention was added in each emulsion layer.

Each of the thus prepared Samples 101 to 105 was exposed to light through a usual wedge for 1/100 sec. and developed according to the color-developing process in Example 1, provided that the color-developing time was 3 min 15 sec. Then, the magenta density of each processed sample was measured.

The sensitivity was shown as a relative value of magenta density in logarithm of reciprocal of exposure that gives a density of fog+0.2 (The sensitivity was a relative value to that for Sample 101 being 100).

The results are shown in Table 7.

TABLE 7

| Sample | Added amount of radical scavenger A-3 (mol/mol Ag) | Adding method of radical scavenger | Sensitivity | Fog | Remarks |
|---|---|---|---|---|---|
| 101 | — | — | 100 | 0.12 | Comparative Example |
| 102 | $3 \times 10^{-4}$ | just before coating | 100 | 0.11 | Comparative Example |
| 103 | $6 \times 10^{-4}$ | just before coating | 100 | 0.10 | Comparative Example |
| 104 | $3 \times 10^{-4}$ | in emulsion (before chemical sensitization) | 115 | 0.08 | This Invention |
| 105 | $3 \times 10^{-4}$ + $6 \times 10^{-4}$ | in emulsion (before chemical sensitization) + just before coating | 118 | 0.08 | This Invention |

As is apparent from Table 7, Samples 102 and 103, to each of which was added a compound according to the present invention at the time of coating, provided almost no change of photographic properties, in comparison with Sample 101. On the other hand, Sample 104, in which the compound according to the present invention was added to the emulsion before chemical sensitization of the emulsion, provided a considerable enhancement of sensitivity. Additionally, Sample 105, prepared by adding more of the compound according to the present invention than was used in Sample 104, provided greater sensitivity than that of Sample 104.

With respect to cyan density and yellow density, the same results were obtained.

Having described our invention as related to the present embodiments, it is our intention that the invention not be limited by any of the details of the description, unless otherwise specified, but rather be construed broadly within its spirit and scope as set out in the accompanying claims.

What we claim is:

1. A method of manufacturing a silver halide emulsion, which comprises:

subjecting a silver halide emulsion to reduction sensitization;

adding to said reduction sensitized emulsion at least one radical scavenger represented by formula (A):

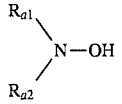

Formula (A)

wherein $R_{a1}$ represents an alkyl group, and alkenyl group, an aryl group, a heterocyclic group, an acyl group, a sulfonyl group, a sulfinyl group, a carbamoyl group, a sulfamoyl group, an alkoxycarbonyl group, or an aryloxycarbonyl group; $R_{a2}$ is a hydrogen atom or a group represented by $R_{a1}$, with the proviso that when $R_{a1}$ is an alkyl group, an alkenyl group, or an aryl group, $R_{a2}$ is a heterocyclic group, an acyl group, a sulfonyl group, a sulfinyl group, a carbamoyl group, a sulfamoyl group, an alkoxycarbonyl group, or an aryloxycarbonyl group; and $R_{a1}$ and $R_{a2}$ may combine together to form a 5- to 7-membered ring; and subjecting said reduction sensitized emulsion to gold chalcogen sensitization;

wherein said radical scavenger is added prior to completion of said gold chalcogen sensitization.

2. The method of manufacturing a silver halide emulsion as claimed in claim 1, wherein the emulsion is subjected to reduction sensitization during growth of the silver halide grains of the emulsion.

3. The method of manufacturing a silver halide emulsion as claimed in claim 1, wherein the radical scavenger is added before the beginning of chemical sensitization.

4. The method of manufacturing a silver halide emulsion as claimed in claim 1, wherein the radical scavenger is contained in an amount of $1\times10^{-5}$ to $1\times10^{-2}$ mol/mol Ag.

5. A silver halide photosensitive material that comprises a support having thereon at least one layer containing a silver halide emulsion, said silver halide emulsion containing reduction and gold chalcogen sensitized silver halide grains and a radical scavenger represented by formula (A):

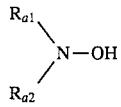

Formula (A)

wherein $R_{a1}$ represents an alkyl group, an alkenyl group, an aryl group, a heterocyclic group, an acyl group, a sulfonyl group, a sulfinyl group, a carbamoyl group, a sulfamoyl group, an alkoxycarbonyl group, or an aryloxycarbonyl group; $R_{a2}$ is a hydrogen atom or a group represented by $R_{a1}$, with the proviso that when $R_{a1}$ is an alkyl group, an alkenyl group, or an aryl group, $R_{a2}$ is a heterocyclic group, an acyl group, a sulfonyl group, a sulfinyl group, a carbamoyl group, a sulfamoyl group, an alkoxycarbonyl group, or an aryloxycarbonyl group; and $R_{a1}$ and $R_{a2}$ may combine together to form a 5- to 7-membered ring;

wherein said radical scavenger was added to said emulsion after reduction sensitization and prior to the completion of gold chalcogen sensitization.

6. The silver halide photosensitive material as claimed in claim 5, wherein the emulsion was subjected to reduction sensitization during growth of the silver halide grains of the emulsion.

7. The silver halide photosensitive material as claimed in claim 5, wherein the radical scavenger is added before the beginning of chemical sensitization.

8. The silver halide photosensitive material as claimed in claim 5, wherein the radical scavenger is contained in an amount of $1\times10^{-5}$ to $1\times10^{-2}$ mol/mol Ag.

9. The silver halide photosensitive material as claimed in claim 5, containing at least one compound selected from the compounds represented by general formula (B), (C), or (D):

general formula (B) $R^3$—$SO_2S$—M general formula (C) $R^3$—$SO_2S$—$R^4$ general formula (D) $R^3$—$SO_2S$—$L_m$—$SSO_2$—$R^5$ wherein $R^3$, $R^4$, and $R^5$, which are same or different, each represent an aliphatic group, an aromatic group, or a heterocyclic group; L represents a divalent group; M represents a cation; and m represents an integer of 0or 1.

10. The silver halide photosensitive material as claimed in claim 9, containing a compound represented by the general formula (B).

11. The silver halide photosensitive material as claimed in claim 9, wherein the compound represented by general formula (B), (C), or (D) is added during growth of the silver halide grains of the emulsion.

12. The silver halide photosensitive material as claimed in claim 5, containing at least a color coupler.

13. A silver halide photosensitive material, comprising at least one silver halide emulsion layer on a support, wherein the emulsion layer comprises a silver halide emulsion having (1) reduction and chemically sensitized silver halide grains and (2) a radical scavenger represented by general formula (A), wherein said radical scavenger was added to said emulsion prior to the completion of chemical sensitization:

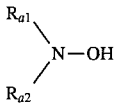

general formula (A)

wherein $R_{a1}$ represents an alkyl group, an alkenyl group, an aryl group, a heterocyclic group, an acyl group, a sulfonyl group, a sulfinyl group, a carbamoyl group, a sulfamoyl group, an alkoxycarbonyl group, or an aryloxycarbonyl group; $R_{a2}$ is a hydrogen atom or a group represented by $R_{a1}$, with the proviso that when $R_{a1}$ is an alkyl group, an alkenyl group, or an aryl group, $R_{a2}$ is a heterocyclic group, an acyl group, a sulfonyl group, a sulfinyl group, a carbamoyl group, a sulfamoyl group, an alkoxycarbonyl group, or an aryloxycarbonyl group; and $R_{a1}$ and $R_{a2}$ may combine together to form a 5- to 7-membered ring.

14. The silver halide photosensitive material as claimed in claim 13, wherein said reduction and chemically sensitized silver halide grains in said emulsion are tabular silver halide grains having an aspect ratio of not less than 3, and having dislocation lines, in an amount of at least 60% of the total projected area of these grains.

15. The silver halide photosensitive material as claimed in claim 13, containing at least a color coupler.

16. The silver halide photosensitive material as claimed in claim 13, wherein the emulsion was subjected to reduction sensitization during growth of the silver halide grains of the emulsion.

17. The silver halide photosensitive material as claimed in claim 13, wherein $R_{a1}$ is a heterocyclic group.

18. The silver halide photosensitive material as claimed in claim 13, wherein $R_{a1}$ is a heterocyclic aromatic group.

19. The silver halide photosensitive material as claimed in claim 13, wherein the radical scavenger is represented by general formula (A-I):

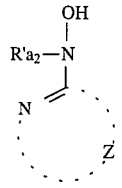

general formula (A-I)

wherein $R'_{a2}$ represents at hydrogen atom, an alkyl group, an alkenyl group, or an aryl group, and Z represents a heterocyclic aromatic group.

20. The silver halide photosensitive material as claimed in claim 13, wherein the radical scavenger is represented by general formula (A-II):

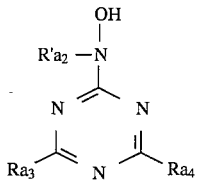

general formula (A-II)

wherein $R'_{a2}$ represents a hydrogen atom, an alkyl group, an alkenyl group, or an aryl group, and $R_{a3}$ and $R_{a4}$, which are same or different, each represent a hydrogen atom or a substituent.

21. The silver halide photosensitive material as claimed in claim 13, wherein the radical scavenger is added before the beginning of chemical sensitization.

22. The silver halide photosensitive material as claimed in claim 13, wherein the radical scavenger is contained in an amount of $1\times10^{-5}$ to $1\times10^{-2}$ mol/mol Ag.

23. The silver halide photosensitive material as claimed in claim 13, containing at least one compound selected from the compounds represented by general formula (B), (C), or (D):

general formula (B) $R^3$—$SO_2S$—M general formula (C) $R^3$—$SO_2S$—$R^4$ general formula (D) $R^3$—$SO_2S$—$L_m$—$SSO_2$—$R^5$ wherein $R^3$, $R^4$, and $R^5$, which are same or different, each represent an aliphatic group, an aromatic group, or a heterocyclic group; L represents a divalent group; M represents a cation; and m represents an integer of 0 or 1.

24. The silver halide photosensitive material as claimed in claim 23, containing a compound represented by the general formula (B).

25. The silver halide photosensitive material as claimed in claim 23, wherein the compound represented by general formula (B), (C), or (D) is added during growth of the silver halide grains of the emulsion.

* * * * *